US008477127B2

(12) United States Patent
Tanaka et al.

(10) Patent No.: US 8,477,127 B2
(45) Date of Patent: Jul. 2, 2013

(54) LIQUID CRYSTAL DISPLAY DEVICE AND METHOD OF DRIVING THE SAME

(75) Inventors: Yukio Tanaka, Ishikawa-ken (JP); Tetsuo Fukami, Ishikawa-ken (JP); Emi Higano, Ishikawa-ken (JP); Shigesumi Araki, Toyama-ken (JP); Ken Shiiba, Ishikawa-ken (JP)

(73) Assignee: Japan Display Central Inc., Fukaya-shi (JP)

( * ) Notice: Subject to any disclaimer, the term of this patent is extended or adjusted under 35 U.S.C. 154(b) by 688 days.

(21) Appl. No.: 12/771,191

(22) Filed: Apr. 30, 2010

(65) Prior Publication Data

US 2010/0289786 A1 Nov. 18, 2010

(30) Foreign Application Priority Data

May 15, 2009 (JP) ..... P2009-118613

(51) Int. Cl.
*G09G 5/00* (2006.01)

(52) U.S. Cl.
USPC ..... 345/209; 345/94; 345/96

(58) Field of Classification Search
USPC ..... 345/84–100, 204–215
See application file for complete search history.

(56) References Cited

U.S. PATENT DOCUMENTS 7,894,007 B2 * 2/2011 Fukami et al. ..... 349/37
7,956,832 B2 * 6/2011 Tanaka et al. ..... 345/87
2006/0092111 A1 5/2006 Nakao et al.
2008/0024404 A1 1/2008 Tanaka et al.
2008/0024405 A1 1/2008 Fukami et al.
2008/0074568 A1 3/2008 Tanaka et al.
2008/0278644 A1 11/2008 Fukami et al.
2008/0278647 A1 11/2008 Fukami et al.

FOREIGN PATENT DOCUMENTS

JP 2000-194017 7/2000
JP 2002-55661 2/2002
JP 2004-354742 12/2004
JP 2007-121571 5/2007

OTHER PUBLICATIONS

Office Action issued Sep. 13, 2011 in Japan Application No. 2009-118613 (English Translation).
U.S. Appl. No. 12/877,551, filed Sep. 8, 2010, Tanaka, et al.
Office Action issued Mar. 13, 2012, in Japanese Patent Application No. 2009-118613 English translation only.
U.S. Appl. No. 12/626,782, filed Nov. 27, 2009, Ken Shiiba et al.

* cited by examiner

*Primary Examiner* — Vijay Shankar
(74) *Attorney, Agent, or Firm* — Oblon, Spivak, McClelland, Maier & Neustadt, L.L.P.

(57) ABSTRACT

A liquid crystal display device includes a display portion having a first substrate, a second substrate opposing to the first substrate, a liquid crystal layer held between the first and second substrates, and a plurality of pixels arranged in a delta shape. A plurality of pixel electrodes are respectively connected to signal lines extending in a first direction via a switch. The switch is controlled by scanning lines extending in a second direction which orthogonally crosses the first direction. The signal lines extend in a space between the pixel electrodes in a meandering shape in the second direction, and two kinds of color pixels are connected with a common signal line in turn via the pixel switch.

22 Claims, 15 Drawing Sheets

LIQUID CRYSTAL DISPLAY DEVICE AND METHOD OF DRIVING THE SAME

CROSS-REFERENCE TO RELATED APPLICATION

This application is based upon and claims the benefit of priority from prior Japanese Patent Application No. 2009-118613, filed May 15, 2009, the entire contents of which are incorporated herein by reference.

BACKGROUND OF THE INVENTION

1. Field of the Invention

The present invention relates to a liquid crystal display device, and more particularly to a liquid crystal display device using a delta arrangement of pixels and a method of driving the same.

2. Description of the Related Art

The liquid crystal display device includes a pair of substrates, a liquid crystal layer held between the pair of substrates, and a display portion formed of a plurality of display pixels. In a case of a color type liquid crystal display device, each of the plurality of display pixels includes some kinds of color pixels.

Namely, when each of the display pixels is formed of a red pixel to display red color, a green pixel to display green color, and a blue pixel to display blue color, an arrangement method of pixels may be used, in which the red pixel, the blue pixel and the green pixel are arranged in a stripe shape so as to line every same color pixels.

When arranging the pixels in a stripe shape for every same color, the pixels that are arranged at the edge of the display portion are same color pixels in a direction where a stripe-like line extends. Therefore, a line of the single color might be recognized visually at the edge of the display portion. Furthermore, cracks between adjacent lines of the pixels arranged in a line may be also recognized visually in the stripe shape.

Other pixel arrangement (hereafter referred to a delta arrangement) which shifts each of adjacent pixels arranged in a row direction to 1.5 pixel span of each color pixel with respect to adjoining row lines of pixels is proposed in a Japanese laid open patent application No. 2000-194017. According to the delta arrangement, since the pixels of the same color are not arranged in a line at the end of a display portion, the line of a single color is not recognized visually at the end of the display portion. Furthermore, since the pixels are not lined in a column direction, the edge of the display portion is not recognized visually in a line shape, which prevents a decrease of the display quality.

Generally, the liquid crystal display device adopts an alternating electric field driving, that is, a polarity of a voltage applied to the liquid crystal layer is inversed in every selected scan line as countermeasure against flicker. However, if only one of the polarity changes in every selected scan line and every selected signal line is adopted, the flicker may be generated in a direction in which scan lines or signal lines extend. Accordingly, in a high quality liquid crystal display device, a dot inversion driving in which the polarity of the voltage applied to the liquid crystal layer is inversed both in every selected scan line and every selected signal line.

On the other hand, a capacitive coupling driving (CC driving) is proposed to decrease an amplitude of signal voltages. In the capacitive coupling driving, a predetermined pixel voltage is obtained by adding an auxiliary capacitance signal to a pixel electrode through an auxiliary capacitance. If the capacitance values of the auxiliary capacitance and a pixel capacitance are set substantially equal, the amplitude of the signal voltage is reduced by half.

On the other hand, a black insertion driving is known to prevent a smudgy display, that is, a scan for the black insertion driving and a scan for writing image signals into the pixel are conducted within one frame scan period. Furthermore, a selection driving is used to lower cost by reducing number of driver circuits and peripheral wiring area to achieve a narrow frame display.

In the case of the delta pixel arrangement is used, above described CC driving, the capacitive coupling dot inversion driving (CCDI driving), the selection driving, and the black insertion driving may be also applied to achieve the low power consumption and the narrow frame display. Here, especially, the CC driving applicable to the dot inversion driving is called a CCDI driving.

However, if the delta arrangement described in the laid open patent application is adopted, a pattern of the signal wiring for supplying picture signals to the plurality pixels in the liquid crystal display device becomes complicated, which results in difficulty of achieving the low power consumption and the narrow frame display by using the delta arrangement.

The present invention is accomplished in light of the above-mentioned circumstances. The purposes of the present invention is to provide a high quality liquid crystal display device and a method driving the same, using a delta arrangement capable of achieving a low power consumption and a narrow frame display device.

BRIEF SUMMARY OF THE INVENTION

The present invention has been made to address the above mentioned problems. One object of this invention is to provide a liquid crystal display device capable of reducing power consumption and preventing degradation of the display quality.

Thus, according to one aspect of the invention, there is provided a liquid crystal display device comprising: a display portion including a first substrate, a second substrate opposing to the first substrate, a liquid crystal layer held between the first and second substrates, and a plurality of pixels arranged in a delta shape; the first substrate including; a plurality of pixel electrodes respectively arranged in the pixels, scanning lines extending in a first direction, signal lines extending in a second direction crossing orthogonally with the first direction, and pixel switches arranged around the crossing area of the scanning lines and with signal lines, corresponding to respective pixel electrodes, and; wherein the signal lines extend in a space between the pixel electrodes in a meandering shape in a second direction, and two kinds of color pixels are connected with a common signal line by turn via the pixel switch.

According to another aspect of the invention, there is provided a method of driving a liquid crystal display device having a display portion including a first substrate, a second substrate opposing to the first substrate, a liquid crystal layer held between the first and second substrates, and a plurality of pixels arranged in a delta shape; the first substrate including, a plurality of pixel electrodes respectively arranged in the pixels, scanning lines extending in a first direction, signal lines extending in a second direction crossing orthogonally with the first direction, and pixel switches arranged around the crossing area of the scanning lines and the signal lines, corresponding to respective pixel electrodes, the method comprising the steps of: forming the signal lines extending in a space between the pixel electrodes in a meandering shape in a second direction, and two kinds of color pixels connected with a common signal line in turn via the pixel switch, turning on the pixel switch by the scanning line sequentially driven under control of a scanning line driving circuit, writing a signal into the pixels via the pixel switch from the signal lines under control of a signal line driving circuit, inversing respective polarity of signals supplied to the pixel electrode arranged in the first direction one by one base and respective polarity of the signals supplied to the pixel electrodes from a common signal line every two or more pixel electrodes arranged adjacently.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A liquid crystal display device, according to an exemplary embodiment of the present invention, in particular, a liquid crystal display device and a method of driving the same using a delta pixel arrangement will be explained.

Figure 1:
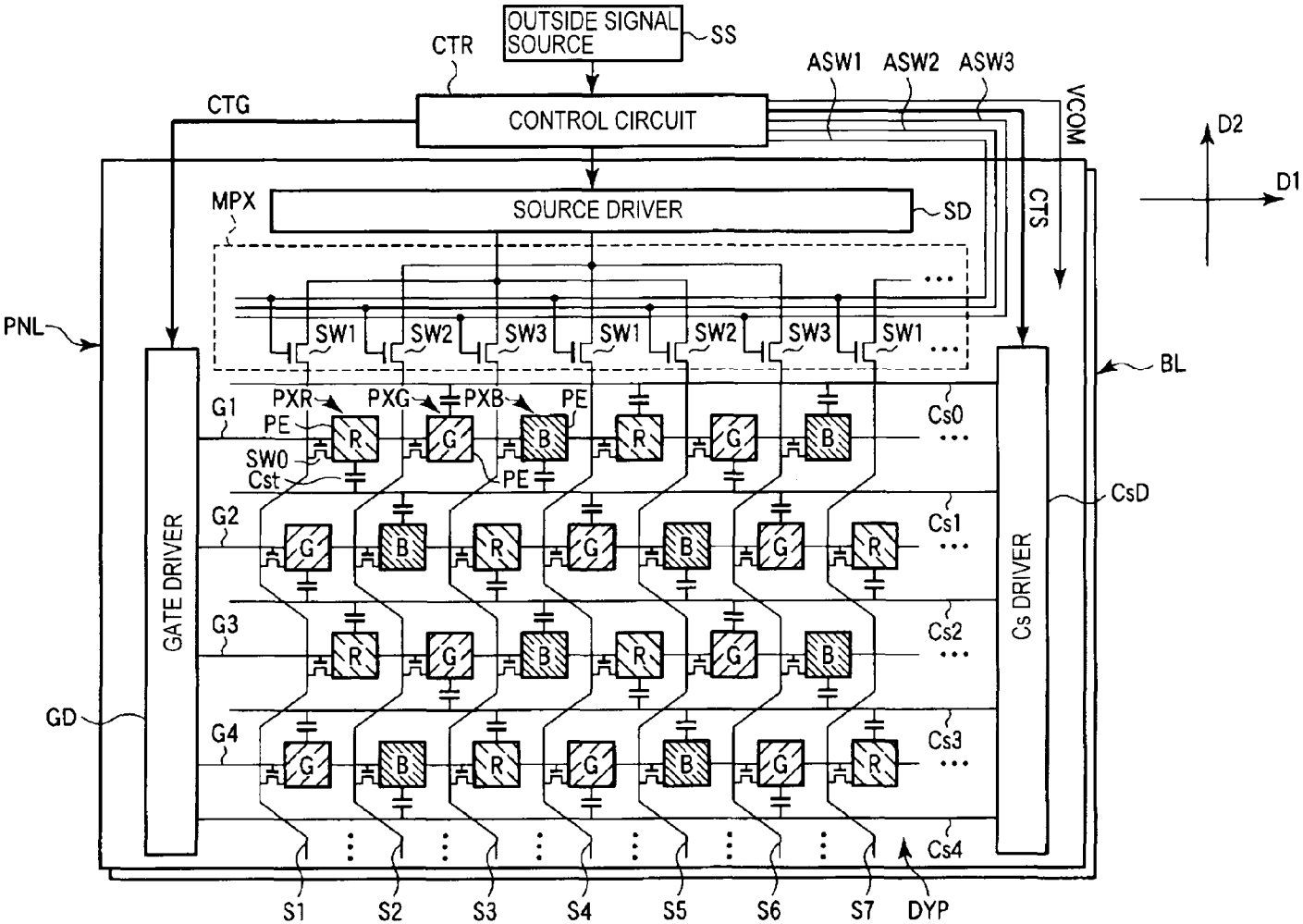
FIG. 1 is a diagram showing a basic structure of a liquid crystal display device according to the present invention.

Hereafter, a basic structure of a liquid crystal display device and a driving method of the liquid crystal display device according to the present invention is explained referring to FIG. 1. The Liquid crystal display device includes a liquid crystal display panel PNL having a display portion DYP formed of a plurality of display pixels PX, a back light BL to illuminate the liquid crystal display portion DYP, and a control circuit CTR to control the liquid crystal display panel PNL and the back light BL.

The liquid crystal display device panel PNL has an array substrate (not shown) and an opposite substrate (not shown), and a liquid crystal layer held between the array substrate and the opposite substrate. In the liquid crystal display device according to this embodiment, a delta pixel arrangement is adopted.

The liquid crystal display device according to this embodiment is a color type liquid crystal display device, and each of the display pixels PXs includes a plurality of color pixels. The liquid crystal display device shown in FIG. 1 includes a red pixel PXR to display red color, a green pixel PXG to display green color, and a blue pixel PXB to display blue color.

The plurality of display pixel PXs include a plurality of pixels arranged in a first D1 direction (row direction), in a predetermined order. Each of the color pixels in a row line is arranged so as to shift by 1.5 pixel span to the color pixels arranged in the adjoining row lines in the row direction.

The array substrate includes a transparent insulation substrate, such as glass, for example. A plurality of pixel electrodes corresponding to the respective display pixels PXs are arranged on the transparent insulation substrate. A plurality of scanning lines G (G1~Gm) are arranged along with the row line in which the pixel electrodes PE are arranged. Furthermore, a plurality of signal lines S (S1~Sn) are arranged in a space between adjacent pixel electrodes PE along the second direction D2 in a zigzag style. A plurality of auxiliary capacitance lines Cs (Cs0~Csm−1) are arranged substantially in parallel with the scan lines G, and a plurality of pixel switches SW0 are arranged near the intersection area with the scan lines G and the signal lines S.

Each of the pixel switches SW0 includes a thin film transistor as a switching element, for example. The respective gates of the pixel switches SW0 are connected to the scanning lines G, and a source and drain path is connected between the signal line S and the pixel electrode PE. When each of the pixel switches SW0 is driven by the corresponding scan line G, the switch SW0 becomes conductive between the pixel electrode PE and the corresponding signal line S.

The liquid crystal panel PNL further includes a gate driver GD which successively drives the plurality of scanning lines G1~Gm one by one, a source driver SD which outputs picture signals or non-picture signals to each of the plurality of signal lines S1~Sn in the period when the respective pixel switches SW0 are selected by corresponding scanning lines G, a Cs driver CsD which drives the plurality of auxiliary capacitance lines Cs0~Csm−1, and a selection circuit MPX which distributes the signals outputted from the source driver SD to the plurality of signal lines S.

Some external ICs are used to form the gate driver GD, the source driver SD, and the Cs driver CsD or the drivers may be built on the array substrate, as built-in circuits. The gate driver GD, the source driver SD, and the selection circuit MPX are arranged in a peripheral portion of the display portion DYP, and are controlled by the control circuit CTR.

The opposite substrate includes a color filter (not shown) formed of a red colored resin, a green colored resin and a blue colored resin on the transparent insulation substrate, such as glass. The opposite substrate further includes an opposite electrode (not shown) which counters the plurality of pixel electrodes, and is arranged on the color filter.

Each of the pixel electrodes PE and the opposite electrode are respectively formed of a transparent material such as ITO and covered with a pair of alignment films in which a rubbing processing is carried out (not shown) in a parallel direction each other respectively. Each of the pixel electrodes PE and the opposite electrode constitute a display pixel PX with a pixel field which is a part of the liquid crystal layer controlled by the electric field between the pixel electrode PE and the opposite electrode.

The plurality of color pixels are classified according to the colors of the layers arranged in the respective color pixels. The red pixel PXR contains a red color layer. The green pixel PXG contains a green color layer. Similarly, the blue pixel PXB contains a blue color layer.

Each of the display pixel PXs has a liquid crystal capacitance (not shown) formed by the liquid crystal layer held between the pixel electrode PE and the opposite electrode. The liquid crystal capacitance value is decided by a specific inductive capacitance of liquid crystal material, a pixel electrode area, and a cell gap between the pixel electrode PE and the opposite electrode.

A voltage (hereafter referred as a source voltage) supplied to the signal line S by the source driver SD is supplied to the pixel electrode PE of the display pixel PX through a corresponding pixel switch SW0. A potential difference between a voltage (pixel potential) impressed to the pixel electrode PE and a opposite common voltage Vcom impressed to the opposite common electrode is maintained by the liquid crystal capacitance.

An auxiliary capacitance Cst is formed by a portion of the pixel electrode PE laminated via an insulating film and the auxiliary capacitance line Cs (Cs0~Csm−1) extending in parallel with the scanning line G. The auxiliary capacitance Cst is combined with the liquid crystal capacitance in a holding period after writing the picture signals into the pixel electrode PE.

A control circuit CTR outputs a control signal CTG generated based on a synchronized signal inputted from an outside signal source SS to the gate driver GD. Similarly, the control circuit CTR outputs a control signal CTS generated based on the synchronized signal inputted from the outside signal source SS, picture signals or a reverse transference prevention signal for a black insertion, inputted from the outside signal source SS to the source driver SD. The control circuit CTR also outputs the opposite common voltage Vcom impressed to the opposite electrode of the opposite substrate.

The source driver SD outputs a plurality of picture signals or the reverse transference prevention signals in parallel. The outputted signals from the source driver SD are distributed to the signal lines S1~Sn by the selection circuit MPX.

The selection circuit MPX includes a first switch SW1 having ON and OFF states controlled by a first control signal ASW1, a second switch SW2 controlled by a second control signal ASW2, and a third switch SW3 controlled by a third control signal ASW3. The signal outputted from the source driver SD is supplied to a corresponding signal line S via either one of the first switch SW1, the second switch SW2 and the third switch SW3.

According to this embodiment, the CCDI driving is adopted. In the CCDI driving, after signals are written in the pixels from the selected signal line S, a superposed voltage by capacitive coupling is applied to the potential of the pixel electrode PE, and an increased amplitude effect is acquired.

Figure 2:
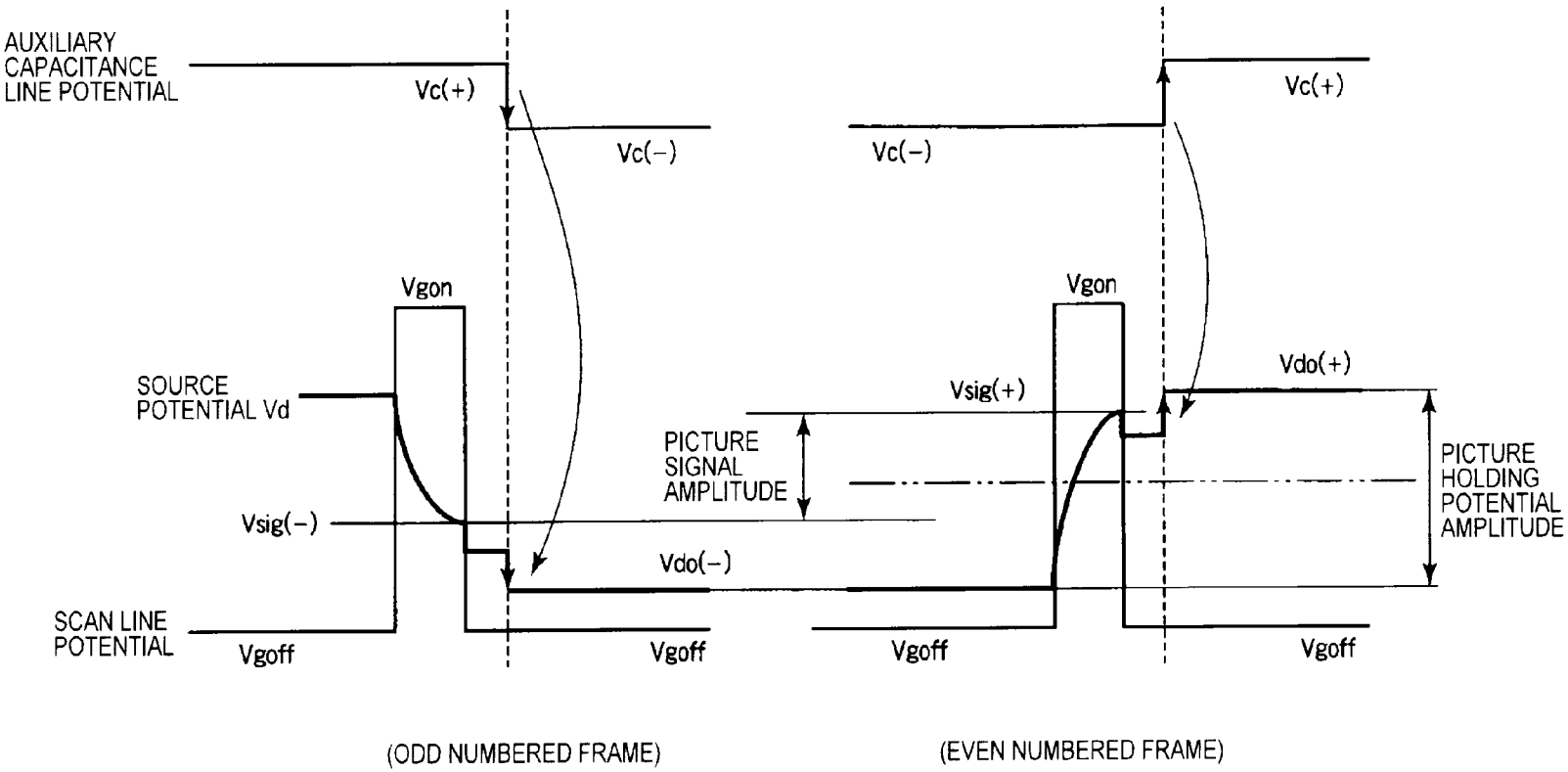
FIG. 2 is a timing chart showing a driving operation of the liquid crystal display device shown in FIG. 1.

Specifically, the auxiliary capacitance Cst is formed between the auxiliary capacitance line Cs extending in the first direction D1 and the pixel electrode PE, by applying a voltage from the Cs driver CsD as shown in FIG. 2.

Immediately after the scan lines G are selected, the potential of the auxiliary capacitance line Cs is changed from a positive potential Vc(+) to a negative potential Vc(−) or from the negative potential Vc(−) to the positive potential Vc(+). Consequently, a larger voltage amplitude to hold the pixel than a range (picture signal amplitude) of the signal voltage given to the pixel electrode PE from the signal line S can be obtained by applying a coupling voltage through the coupling capacitance to the pixel electrode PE.

According to the CC driving, the source driver SD with small voltage amplitude can be used, and merits of driver cost reduction and power consumption reduction are obtained. If the auxiliary capacitance line Cs is commonly connected to respective auxiliary capacitances Cst of the pixels lined in one selected scanning line G, the polarity of the superimposed voltage to the pixel electrodes PE becomes the same for all the pixels in one row. Therefore, the CC driving can not be applied to the dot inversion driving, in which positive and negative polarities of the pixels selected by a common scanning line G are mixed within a row line.

In case of applying the CC driving to the dot inversion driving, it is necessary to prepare a pair of auxiliary capacitance lines Cs to generate, for example, an auxiliary capacitance Cst for the pixel electrodes PE to which a positive signal is applied using an upper side auxiliary capacitance line Cs, and another auxiliary capacitance Cst for the pixel electrodes PE to which a negative signal is applied using a lower side auxiliary capacitance line Cs. Here, the pair of auxiliary capacitance lines Cs of upper and lower sides are illustrated in parallel with scan lines G so as to interleave the pixel electrode PE arranged in the row direction in FIG. 1.

Therefore, in the liquid crystal display shown in FIG. 1, two types of pixels PX selected by a common scanning line G exist in mixture. Namely, in one type pixel PX, the auxiliary capacitance Cst is formed between the upper auxiliary capacitance line Cs and the pixel electrode PE, and in another type of pixel, the auxiliary capacitance Cst is formed between the lower auxiliary capacitance line Cs and the pixel electrode PE.

In the CC driving (line reversal driving or frame reversal driving) in which all the pixels PX in one row line have the same polarity, an undesirable horizontal cross talk generates due to coupling between the signal line S and the opposite electrode or the auxiliary capacitance line Cs. However, in the CCDI driving, since positive/negative polarities are mixed, the coupling is set off by positive/negative polarities, and the generation of the horizontal cross talk is suppressed, which results in the prevention of the cross talk.

In the line reversal driving, when the opposite electrode potential shifts, a line flicker may be seen. However, in the dot inversion driving, even if the opposite electrode potential shifts, the line flicker cannot be easily seen.

In the liquid crystal display device according to this embodiment, a selection driving which uses a selection circuit MPX is adopted. The selection circuit MPX is provided with a multiplexer. The selection driving distributes output signals from one output terminal SS (shown in FIGS. 11 and 13) of the source driver SD to the plurality of signal lines S in time sharing.

In the selection circuit MPX of FIG. 1, the respective first switch SW1, second switch SW2, and third switch SW3 made of a thin film transistor (TFT: Thin Film Transistor) are inserted between the output terminal SS of the source driver SD and each of the signal lines S. ON/(connection) and OFF/(non-connection) of the TFT are controlled by a potential of the control signal lines ASW (ASW1~ASW3) extending to the selection circuit MPX from the control circuit CTR.

In the liquid crystal display device shown in FIG. 1, a method (three line selection method) is adopted, in which output signals from the output terminal SS of the source driver SD are distributed to three signal lines S. By the selection driving using the selection circuit MPX, the cost reduction due to number reduction of elements constituting the source driver SD is achieved. Furthermore, a narrow picture frame by reducing wiring area in the circumference of the display portion DYP is also achieved.

Figure 3:
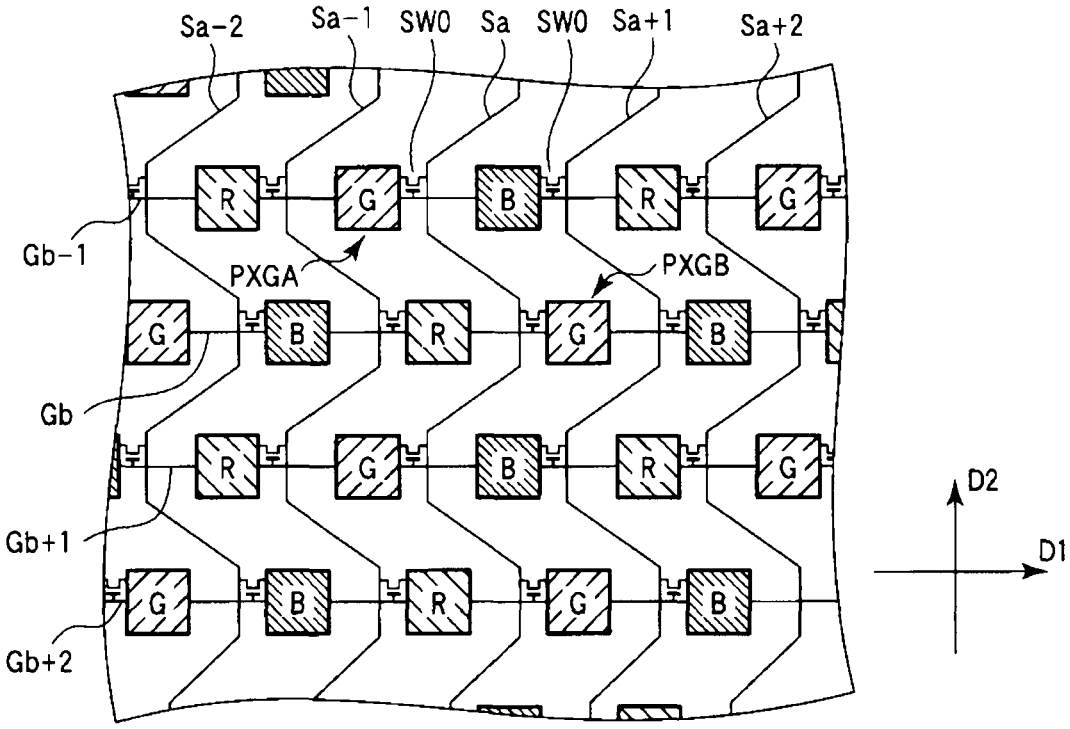
FIG. 3 PRIOR ART
FIG. 3 is a pattern layout of pixels using a delta arrangement of the liquid crystal display device in a prior art.

FIG. 3 is a pattern layout of the pixels using the delta arrangement of the liquid crystal display device in a prior art. An arrangement of the pixel switch SW0 in the pixels PX is explained, in which a delta arrangement is formed. Each signal line S is connected to the respective color pixels of the same color. A signal line Sa is connected to green pixels PXGA and PXGB via the pixel switches SW0 respectively. In this case, when supplying a signal with the same polarity, for example, to the green pixels PXGA and PXGB, the time to charge the signal line Sa is shortened, and shortage of write-in charge is improved.

However, as shown in FIG. 3, when color pixels PX of the same color are connected to the same signal line S, largeness of the potential held at the green pixel PXGA and the green pixel PXGB may differ due to the difference in the largeness of stray capacitance therebetween, which results in a decrease in the display quality.

That is, the pixel electrode PE of the green pixel PXGA is arranged between the signal line Sa and a signal line Sa−1. In a timing when a scanning line Gb−1 is selected, a signal supplied to a pixel electrode PE of a red pixel PXR arranged adjacent to the green pixel PXGA is supplied to the signal line Sa−1. At this time, stray capacitance arises between the pixel electrode PE of the green pixel PXGA, and the signal line Sa−1. The stray capacitance is combined with the pixel capacitance and is held together. Similarly, in the green pixel PXGB, stray capacitance arises between the pixel electrode PE and an adjacent signal line Sa+1, and is combined with the pixel capacitance, thereby this capacitance is also held together.

When the largeness of the stray capacitance combined with the pixel capacitance of the green pixel PXGA differs from that of the stray capacitance combined with the pixel capacitance of the green pixel PXGB, the pictures displayed by the green pixels PXGB and PXGA also differ from each other, and display quality is decreased. That is, a luminosity of the green pixel PXG arranged at even-numbered row lines differs from that of the green pixel PXG arranged at odd-numbered row lines, and horizontal stripes of light and darkness may be recognized visually.

Figure 4:
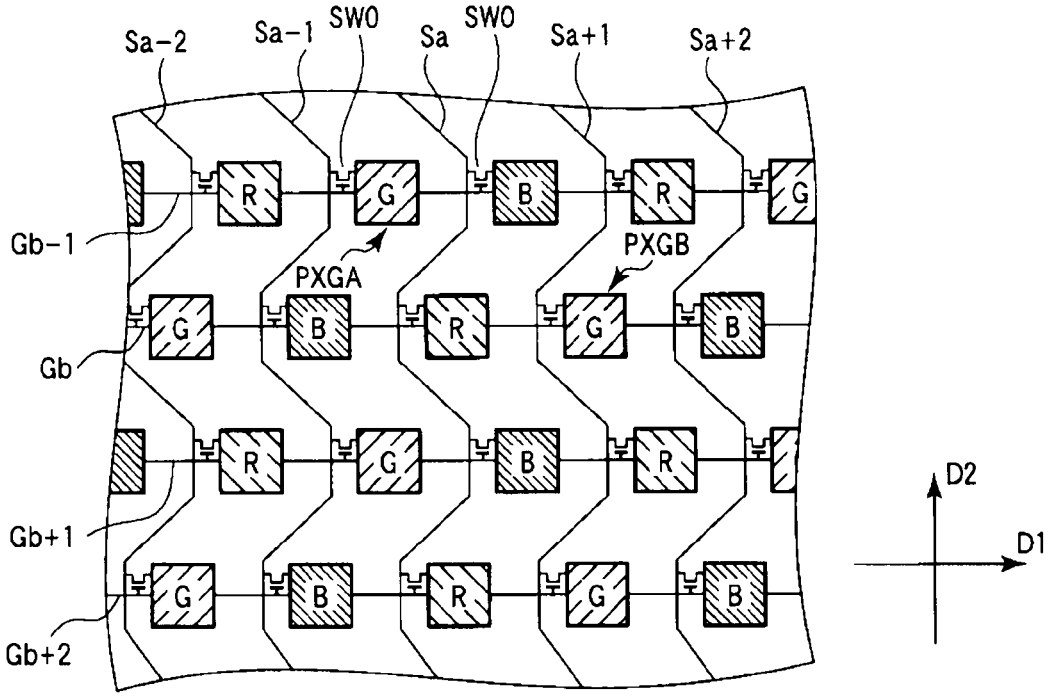
FIG. 4 is a pattern layout of the pixels using the delta arrangement of the liquid crystal display device according to a first embodiment of the present invention.

FIG. 4 is a pattern layout of the pixels using the delta arrangement of the liquid crystal display device according to a first embodiment of the present invention. In the liquid crystal display device shown in FIG. 4, in order to improve that the display device quality decreases as mentioned above, the signal line S is connected with the pixel electrode PE as follows. For example, a pixel electrode PE of a red pixel PXR and a pixel electrode PE of a blue pixel PXB are respectively connected to a common signal line Sa in turn via the switch SW0.

For example, the pixel electrode PE of the green pixel PXGA is arranged between the signal line Sa and the signal line Sa−1. In the timing when the scanning line Gb−1 is selected, a signal supplied to the pixel electrode PE of the blue pixel PXB arranged next is supplied to the signal line Sa. At this time, stray capacitance arises between the pixel electrode PE of the green pixel PXGA and the signal line Sa, and is combined with the pixel capacitance, and the stray capacitance is held together.

Similarly, the pixel electrode PE of the green pixel PXGB is arranged between a signal line Sa+1 and a signal line Sa+2. In a timing when a scanning line Gb is selected, a signal supplied to a pixel electrode PE of a blue pixel PXB arranged next is supplied to the signal line Sa+2. At this time, stray capacitance arises between the picture the electrode PE of the green pixel PXGB and the signal line Sa+2, and combined with the pixel capacitance, and the stray capacitance is held together.

Therefore, the largeness of the capacitance combined with the pixel capacitance of the green pixel PXGA becomes substantially equal to that combined with the pixel capacitance of the green pixel PXGB. Accordingly, the deterioration of the display quality is suppressed.

Next, the polarity of the signal supplied to each of the pixel electrodes PE is explained in the liquid crystal display device according to this embodiment. Generally, if a direct-current (DC) bias is impressed to the liquid crystal layer for a long time, the liquid crystal is charged up, and which results in a problem such as printing phenomenon. In order to prevent the printing phenomenon, the polarity of the applied voltage to the display device is reversed for every frame so that the average of direct-current ingredient of the voltage applied to the liquid crystal layer is set to about 0 V.

However, if the polarity of the signals supplied to all the pixel electrodes (frame inversion driving) is inversed simultaneously, the difference between light and darkness arises for every frame, and a flicker occurs. Then, some inversion driving methods are used, such as a line inversion driving for every row lines, a column inversion driving for every column lines, and a dot inversion driving to inverse the polarity in checkers combining the line inversion driving and the column line inversion driving.

Among these, since the signal supplied to the signal line S is inversed during a signal holding time every 1 horizontal cycle, a DC average value of the signal line potential is set to about 0 in the line inversion driving and the dot inversion driving. Accordingly, even if stray capacitance (Csd) is generated between the pixel electrode PE and the signal line S, an undesirable picture such as a vertical cross talk, is suppressed without giving excessive coupling voltage to the pixel potential Vd.

On the other hand, in the frame inversion driving or the column inversion driving, since the average value of the direct-current ingredient of the signal line potential of a holding time is not about 0, and may be dependent on a display condition of the other pixels arranged in the same column line and in other row lines. Accordingly, if there is stray capacitance (Csd), the holding voltage of the pixel electrode PE is influenced by a display condition of the other pixels arranged in the same column line and in other row lines, which results in the cross talk.

Figure 5:
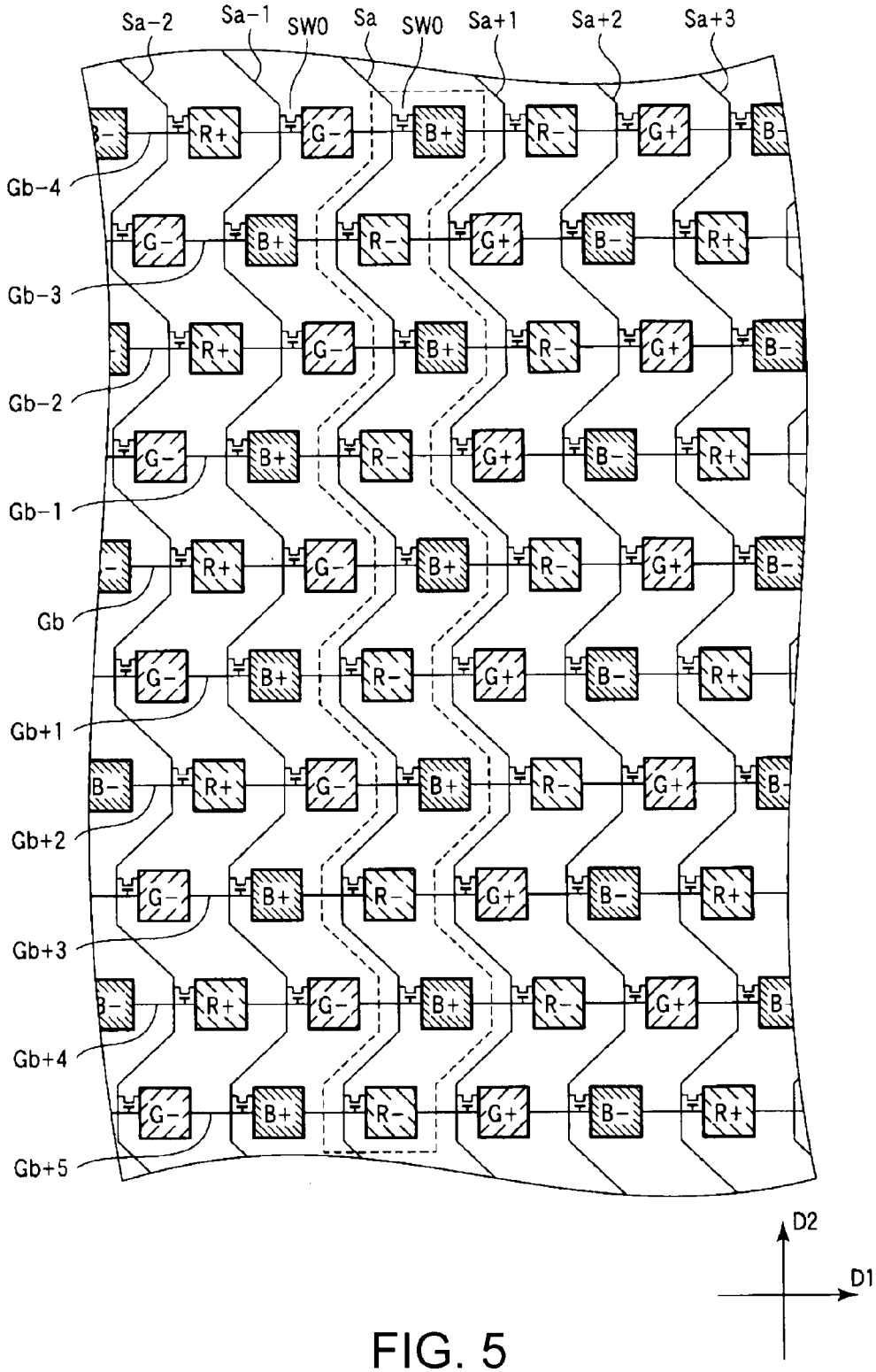
FIG. 5 is a pattern layout of the pixels using the delta arrangement and an alternating driving operation to supply picture signals to pixel electrodes of the liquid crystal display device shown in FIG. 4.

FIG. 5 is a pattern layout of the pixels using the delta arrangement and the alternating driving operation to supply picture signals to the pixel electrodes PE of the liquid crystal display device shown in FIG. 4. In the liquid crystal display device according to this embodiment, the dot inversion driving is adopted as a polarity-inversion method. The polarity of the signal supplied to the pixel electrode PE is inversed every 1 horizontal period (1H) as shown in FIG. 5.

Accordingly, the signals with a mutually different polarity are supplied by turn to the pixel electrodes PE arranged adjacently in the first direction D1. Furthermore, the signals with positive and negative polarities are supplied to the pixel electrodes PE connected to a common signal line S by turns respectively.

Thus, if the signals whose polarity are inversed by turns are supplied to the pixel electrodes PE connected to the same signal line S, the signal with the same polarity is supplied to the pixel electrode PE of the blue pixel PXB connected to the signal line Sa, for example, in one frame period. In FIG. 5, the signals with positive polarity are supplied to the pixel electrodes PE of the blue pixels PXB connected to the signal line Sa.

In the driving method shown in FIG. 5, a vertical cross talk in a gray display is not generated. However, the vertical cross talk occurs by a colored display, such as yellow. This cause is considered as follows. For example, in the display of yellow, a signal corresponding to a white display is supplied to the red pixel PXR, a signal corresponding to a white display is supplied to the green pixel PXG, and a signal corresponding to a black display is supplied to the blue pixel PXB.

The potential supplied to the signal line Sa at this time changes from a potential corresponding to the black display of positive polarity to a potential corresponding to the white display of negative polarity during the holding period, and changes to the potential corresponding to the black display of positive polarity again. The signal potential of positive polarity always turns into the potential for the black display, and the signal potential of negative polarity always turns into the potential for the white display, therefore the average of direct-current (DC) ingredient of the potential of the signal line Sa changes from about 0. Accordingly, a coupling voltage generated by stray capacitance between the source and drain electrodes of the pixel switch SW0 is superposed to the pixel electrode PE, and which results in the potential change of the pixel electrode PE and further the vertical cross talk.

Figure 6:
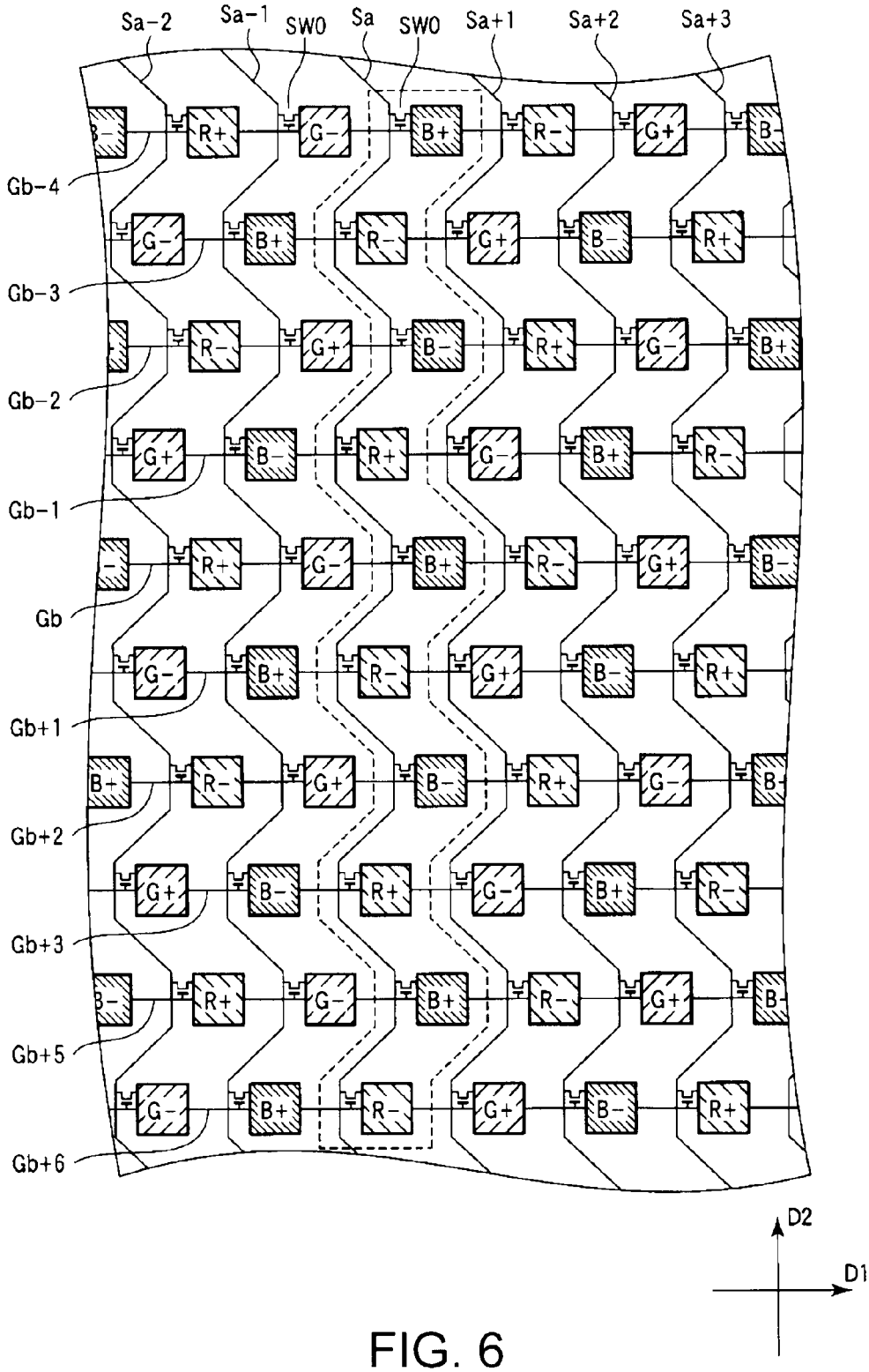
FIG. 6 is a pattern layout of the pixels for a capacitive coupling driving using the delta arrangement and an alternating driving to supply picture signals to the pixel electrodes of the liquid crystal display device shown in FIG. 4 according to a second embodiment of the present invention.

Then, the signal supplied to the pixel electrode PE is inversed every 2 horizontal periods as shown in FIG. 6. FIG. 6 is a pattern layout of the pixels for a capacitive coupling driving using the delta arrangement and the alternating driving to supply picture signals to the pixel electrode PE of the liquid crystal display device shown in FIG. 4 according to a second embodiment of the present invention.

The gate driver GD and the source driver SD controlled by the control circuit CTR inverse the signals applied to the pixels PE arranged in the first direction D1 for every pixel PX. Furthermore, the polarity of the signals supplied to a the pixels PX through the pixel switch SW0 from the signal line S is inversed for two or more pixels PX commonly connected to a signal line S and arranged adjacent each other along the signal line S.

That is, it is a method which makes the polarities of the signals supplied to the pixel electrodes PE connected to the same signal line S as follows: positive polarity (+), negative polarity (−), negative polarity (−), positive polarity (+), positive polarity (+), negative polarity (−), negative polarity (−), and positive polarity (+) for every signal line S.

When yellow color is displayed by this method, the potential of signal line Sa changes from the potential corresponding to the black display of positive polarity to the potential corresponding to the white display of negative polarity during the holding time, further, changes to the potential corresponding to the black display of negative polarity, and then changes to the potential corresponding to the white display of positive polarity If a red pixel PXR is observed here, the direct-current (DC) ingredient of the potential is set off by supplying the potential corresponding to the white display of positive polarity, and the potential corresponding to the white display of negative polarity. Similarly, if a blue pixel PXB is observed, the direct-current (DC) ingredient of the potential is set off by supplying the potential corresponding to the black display of positive polarity, and the potential corresponding to the black display of negative polarity. Consequently, the average of the direct-current of the signal line potential is set to about 0 in a total, and a vertical cross talk is suppressed.

If the polarity of the pixel electrodes PE connected to a common signal line S is set off for each color, the effect of the suppression of the vertical cross talk by such color display can be acquired. Therefore, the same effect is also obtained by the method of inversing every 3 horizontal periods, every 4 horizontal periods and so on.

However, a horizontal-stripes pattern of the light and darkness of a rude pitch may be in sight when the opposite electrode potential shifts especially in the inversion more than every 3 horizontal periods. Therefore, the inversion method for every 2 horizontal periods is more preferred.

Next, the CCDI driving according to this embodiment is explained. Since the signal supplied to the pixel electrode PE differs in the polarity in every column in the CCDI driving, as described above, it is necessary to divide the connection point of the auxiliary capacitance Cst with the auxiliary capacitance line Cs into upper and lower auxiliary capacitance lines Cs with respect to the pixel electrodes PE selected by the common scanning line G in FIG. 7. The auxiliary capacitance lines Cs are arranged in parallel with the scanning line G.

Figure 7:
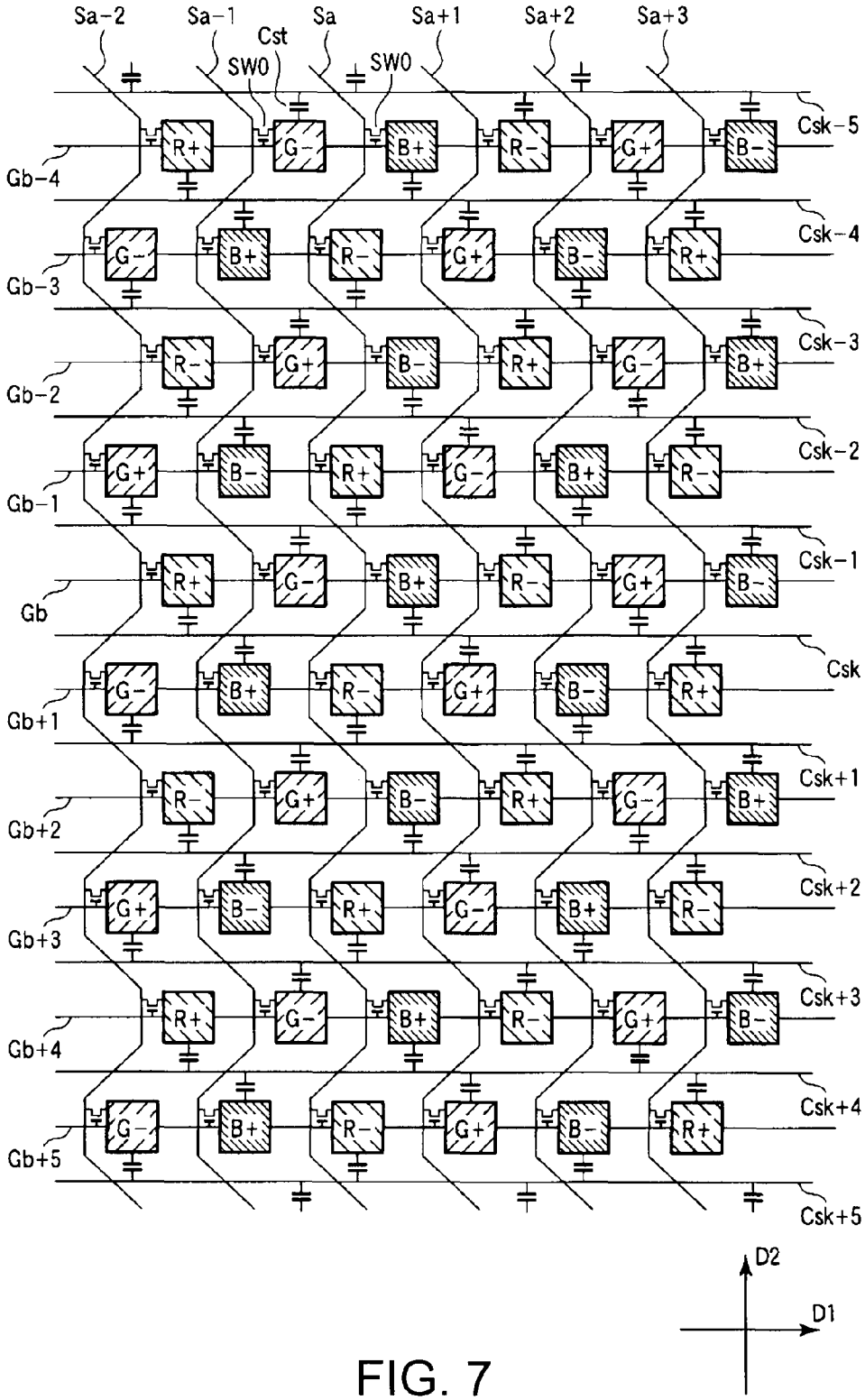
FIG. 7 is a pattern layout of the pixels shown in FIG. 6 with auxiliary capacitances connected to the pixel electrode to show a capacitive coupling driving.

FIG. 7 is a pattern layout of the pixels in case of coupling the auxiliary capacitance to the pixel electrode PE shown in FIG. 6. For example, the pixel electrodes PE connected to a common signal line S via the pixel switch SW0 as shown in FIG. 7 are divided into odd number columns and even number columns in which the pixel electrodes PE are arranged. For example, the respective pixel electrodes PE in the odd number columns (S1, S3, S5, . . . ) are connected to the auxiliary capacitance lines Cs arranged at upper side of the pixel electrodes PE, and the respective pixel electrode PE in the even number columns (S2, S4, S6, . . . ) are connected to the auxiliary capacitance lines Cs arranged at lower side of the pixel electrodes PE.

Figure 8:
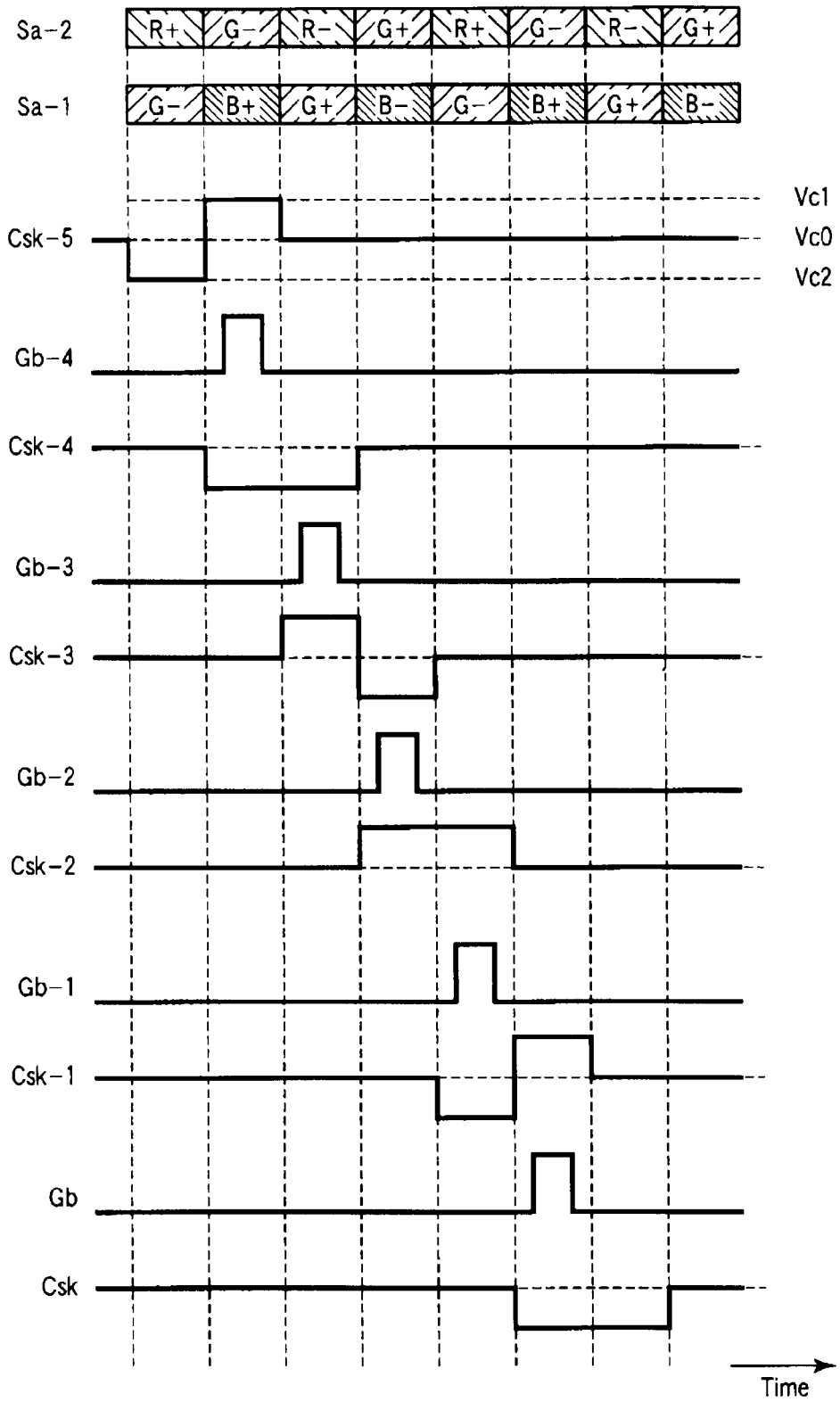
FIG. 8 is a timing chart showing the driving operation by the capacitive coupling driving of the liquid crystal display device shown in FIG. 7.

In this case, if the polarity inversion for every 2 horizontal cycles as shown in FIG. 6 is applied to the above CCDI driving, the control waveform of the auxiliary capacitance potential becomes complicated, and the driving by the Cs driver CsD becomes difficult. When the auxiliary capacitance Cst is arranged as shown in FIG. 7, waveforms of the scanning line G and the auxiliary capacitance line Cs are shown in FIG. 8. The gate driver GD successively selects gate lines G1, G2, G3 and G4 for every 1 horizontal period, then picture signals outputted from the source driver SD are respectively written into the pixel electrodes PE arranged in the selected row lines.

Superposition of the coupling voltage to the pixel electrode PE is performed by controlling the auxiliary capacitance potential Vc. As shown in FIG. 8, the coupling voltage changes corresponding to the change of the auxiliary capacitance potential. That is, at the timing when the signal writing to the pixel electrode PE is performed, the auxiliary capacitance potential (Vc1 or Vc2) is applied to the pixel electrode PE and changes to the (Vc0) for the holding period when a source potential is held in the pixel electrode PE.

For example, a picture signal with positive polarity is written into the red pixel PXR from a signal line Sa−2, which is arranged in a row line selected by a scanning line Gb−4. Auxiliary capacitance Cst of the red pixel PXR is connected to a auxiliary capacitance line Csk−4 shown at the lower side of the pixel electrode PE, and the coupling voltage is impressed to the pixel electrode PE from the auxiliary capacitance line Csk−4.

The potential of the auxiliary capacitance line Csk−4 at the timing when the scanning line Gb−4 is selected is Vc2, and the potential of the auxiliary capacitance line Csk−4 at the holding period when the source potential is held in the pixel electrode PE is Vc0, as shown in FIG. 8. Therefore, a positive coupling voltage corresponding to the difference between the potential Vc0 and the potential Vc2 is superposed to the pixel voltage of the pixel electrode PE Similarly, a picture signal with negative polarity is written into the green pixel PXG from a signal line Sa−1, which is arranged in the row line selected by the scanning line Gb−4. The auxiliary capacitance Cst of the green pixel PXG is connected to a auxiliary capacitance line Csk−5 shown at the upper side of the pixel electrode PE, and the coupling voltage is impressed to the pixel electrode PE from the auxiliary capacitance line Csk−5.

The potential of the auxiliary capacitance line Csk−5 at the timing when the scanning line Gb−4 is selected is Vc1, and the potential of the auxiliary capacitance line Csk−5 at the holding period when the source potential is held in the pixel electrode PE is Vc0, as shown in FIG. 8. Therefore, a negative coupling voltage corresponding to the difference between the potential Vc0 and the potential Vc1 is superposed to the pixel voltage of the pixel electrode PE.

Thus, since the coupling voltage with the same polarity as the picture signal supplied to pixel electrode PE is impressed to the pixel electrode PE, the amplitude of the pixel holding voltage is increased.

Namely, at the timing when the respective scanning lines G are selected, the potential of the auxiliary capacitance line Cs connected via auxiliary capacitance Cst to the pixel electrode PE, in which the signal of positive polarity is supplied, is set to potential Vc2. On the contrast, the potential of the auxiliary capacitance line Cs connected via auxiliary capacitance Cst to the pixel electrode PE, in which the signal of negative polarity is supplied, is set to potential Vc1 in order to achieve a desired amplitude increase effect. If the potential of each auxiliary capacitance line Cs is set as mentioned above, the potential waveform of the auxiliary capacitance line Cs becomes as shown in FIG. 8.

However, in the potential waveform of the auxiliary capacitance line Cs as shown in FIG. 8, the potential of the auxiliary capacitance lines Csk−5, Csk−3, Csk−1 changes among three values (Vc0, Vc1, Vc2). On the contrast, the potential of the auxiliary capacitance lines Csk−4, Csk−2, Csk changes between two values. Accordingly, the drive waveform becomes different by even-numbered auxiliary capacitance lines Cs and odd-numbered auxiliary capacitance lines Cs.

In this waveform, since it is necessary to carry out different driving control between even-numbered auxiliary capacitance lines Cs and odd-numbered auxiliary capacitance lines Cs, the circuit of Cs driver CsD is complicated, and which may result in cost up and an increase in frame area.

When auxiliary capacitance lines Csk−5, Csk−3, Csk−1 shift from the first level to the second level, it is necessary to change the potential from the potential Vc1 to the potential Vc2, or from the potential Vc2 from the potential Vc1. Therefore, if time constant of the auxiliary capacitance line Cs is large, the potential of the second level may not be stable within 1 horizontal period. In the case, a difference in auxiliary capacitance line potential arises between the auxiliary capacitance lines Csk−5, Csk−3, Csk−1 and the auxiliary capacitance lines Csk−4, Csk−2, Csk whose potentials do not need to be changed, and which results in a poor display, such as a horizontal stripe.

Figure 9:
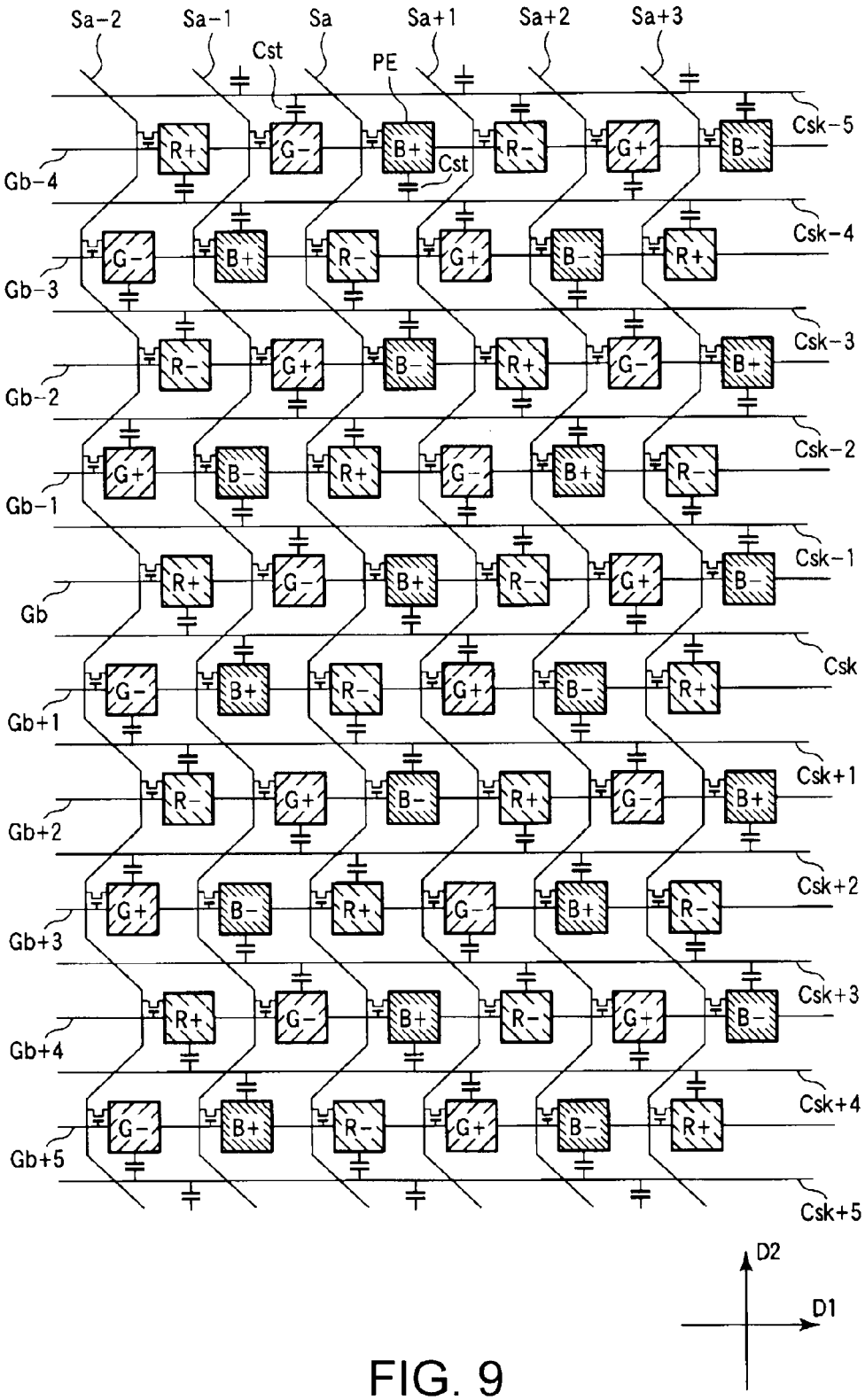
FIG. 9 is a pattern layout of the pixels in case of coupling the auxiliary capacitance to the pixel electrode shown in FIG. 6 according to a third embodiment of the present invention.

Then, in the liquid crystal display device according to this embodiment, an auxiliary capacitance Cst is arranged as shown in FIG. 9. FIG. 9 is a pattern layout of the pixels in case of coupling an auxiliary capacitances to the pixel electrodes PE shown in FIG. 6 according to a third embodiment of the present invention.

In FIG. 9, the pixel electrodes PE lined in a row direction is arranged so as to be sandwiched by a pair of capacitance lines Cs, that is, an upper auxiliary capacitance line Cs and a lower auxiliary capacitance line Cs to supply auxiliary capacitance line voltages of different polarities, respectively. Namely, the auxiliary capacitance lines Cs to supply the auxiliary capacitance line voltages of different voltages are connected to the pixel electrodes PE arranged along a common signal line S in mixture.

For example, in the line of pixels PX selected by the scanning line Gb−4, the pixel electrodes PE to which the picture signals of positive polarity are written in are connected to the auxiliary capacitance line Csk−4 arranged at lower side of the pixel electrode PE via the auxiliary capacitance Cst in FIG. 9.

Similarly, in the line of pixels PX selected by the scanning line Gb−4, the pixel electrodes PE to which the picture signals of negative polarity are written in are connected to the auxiliary capacitance line Csk−5 arranged at upper side of the pixel electrode PE via the auxiliary capacitance Cst.

In the line of pixels PX selected by the scanning line Gb−3, the pixel electrodes PE to which the picture signals of positive polality are written in are connected to the auxiliary capacitance line Csk−4 arranged at upper side of the pixel electrode PE via the auxiliary capacitance Cst.

Similarly, in the line of pixels PX selected by the scanning line Gb−3, the pixel electrode PE to which the picture signals of negative polality are written in are connected to the auxiliary capacitance line Csk−3 arranged at lower side of the pixel electrode PE via the auxiliary capacitance Cst.

Figure 10:
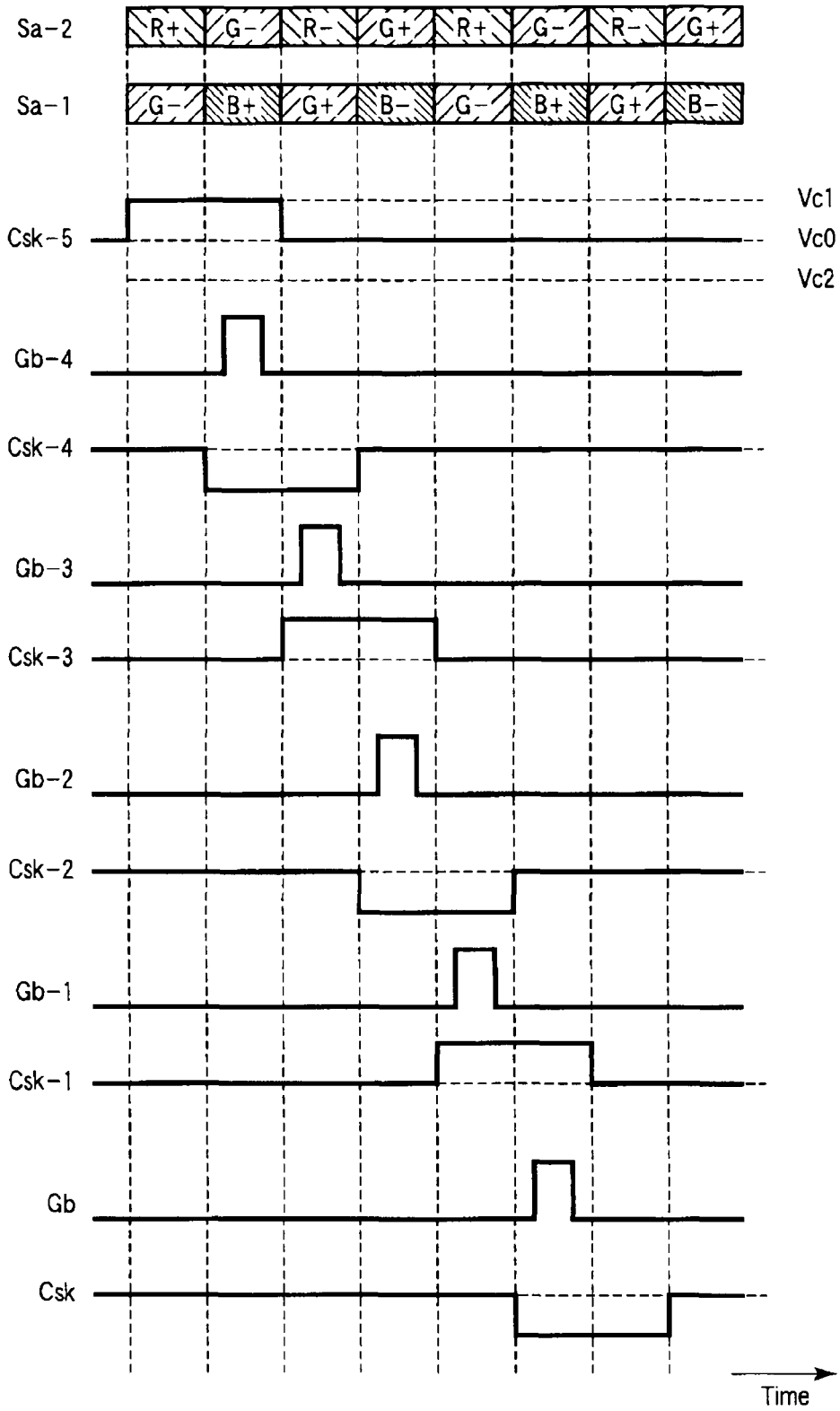
FIG. 10 is a timing chart showing a driving operation by the capacitive coupling driving of the liquid crystal display device shown in FIG. 9.

FIG. 10 shows a driving wave chart of the scanning line G and the auxiliary capacitance line Cs in the case of an arrangement of the auxiliary capacitance Cst as shown in FIG. 9. In the timing when the pixels PX are selected by the scanning line G for every line as shown in FIG. 10, the potential of the auxiliary capacitance line Cs connected to the pixel electrodes PE in which the signals of positive polarity are written in, is set to the potential Vc2. Similarly, the potential of the auxiliary capacitance line Cs connected to the pixel electrodes PE in which the signals of negative polarity are written in, is set to the potential Vc1.

In the driving waveform of the potential of the auxiliary capacitance line Cs shown in FIG. 10, the potential changes with two values about all the auxiliary capacitance lines Cs. For example, signals with negative polarity are written into the pixel electrodes PE connected to an auxiliary capacitance line Csk−3 via auxiliary capacitance Cs.

Therefore, it is necessary to superimpose the coupling voltage of a negative side to the pixel electrodes PE, in the timing when the scanning line Gb−3 and the scanning line Gb−2 are selected. Namely, the potential of an auxiliary capacitance line Csk−3 is set to the potential Vc1.

In the liquid crystal display device according to this embodiment, the polarity of the picture signals written in the pixel electrode PE is inversed every two scanning lines G (cycle of four lines). On the contrary, the polarity of the potential of the auxiliary capacitance line Cs is inversed in every other line (cycle of two lines).

If the auxiliary capacitance line Cs is driven as shown in FIG. 10, the circuit constituting the Cs driver CsD becomes more simple because all the driving waveforms of the auxiliary capacitance line Cs become two steps, and the changing cycle becomes the cycle of two lines from the cycle of four lines. Furthermore, the effect of cost reduction and reduction of frame area is obtained. A poor display such as a horizontal stripe resulting from insufficient potential convergence of the auxiliary capacitance line Cs, can be eliminated.

Figure 11:
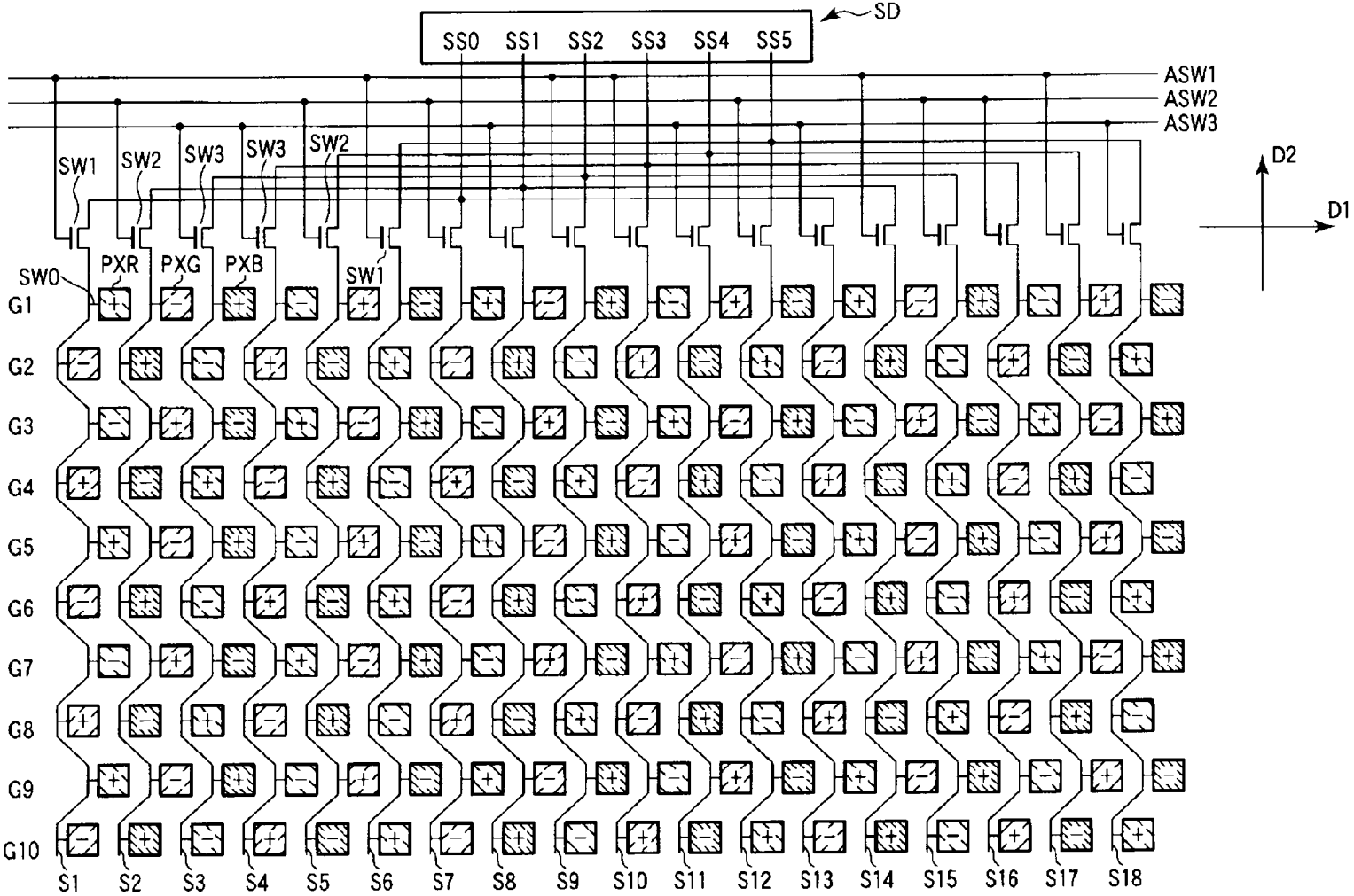
FIG. 11 shows a display portion and a selection circuit in case of conducting an alternating driving operation and a selection driving operation using the pattern layout of pixels shown in FIG. 6 according to a fourth embodiment of the present invention.

Next, the selection driving using a selection circuit MPX in the liquid crystal display device according to an embodiment is explained referring to FIG. 11. FIG. 11 shows the display portion and a selection circuit in case of conducting an alternating driving operation and a selection driving operation using the pattern layout of the pixels shown in FIG. 6 according to a fourth embodiment of the present invention.

FIG. 11 shows the selection circuit MPX which distributes output signals from one output terminal of the source driver SD to a plurality of signal lines S in time sharing. In this embodiment, the output signals from the source driver SD is distributed to 18 signal lines S1-S18, for example from six output terminals SS (SS0-SS5) of the source driver SD. FIG. 11 shows the number of signal lines S as 18, in order to explain easily. However, it is necessary to make the number of signal lines S change according to resolution of a display.

The selection circuit MPX is structured so that the output signals from one output terminal SS of the source driver SD are distributed to a plurality of pixel PXs to which the signals with the same color and the same polarity are supplied.

The control circuit CTR includes a selection drive control means (not shown) which controls the source driver SD and the selection circuit MPX so that the same signals are supplied twice or more to at least one of two or more signal lines S to which the output signals from one output terminal SS are distributed in 1 horizontal period.

When selecting the signal lines S of the same color and the same polarity as a combination of signal lines S selected simultaneously, the output signals from the source driver SD are distributed as shown in FIG. 11. Here, one example is shown about the case (three line selection system) where the output signals from one output terminal of the source driver SD are distributed to three signal lines S. In FIG. 11, although the scanning lines G1~G10 are not illustrated, instead, only the row number is shown. In connection with this, FIG. 11 shows the pixel switch SW0 in simplified manner.

For example, when one of the row lines of the pixels PX selected by a scanning line G1 is observed, the arrangement of the pixels from left-hand side (the direction of an ascending order of signal lines S) is follows: Red pixel PXR (R+) of positive polarity, Green pixel PXG of negative polarity (G−), blue pixel PXB (B+) of positive polarity, Red pixel PXR of negative polarity (R−), green pixel PXG (G+) of positive polarity, Blue pixel PXB of negative polarity (B−), Red pixel PXR of positive polarity (R+), and Green pixel PXG (G−) of negative polarity. The arrangement is periodic, and a pixel PX of the same color and the same polarity appears at interval of 6 pixels.

Therefore, in FIG. 11, output signals from an output terminal SS0 of the source driver SD is distributed to signal lines S1, S7, and S13. Similarly, output signals from an output terminal SS1 of the source driver SD is distributed to signal lines S2, S8, and S14. Thus, the output signals from one output terminal of the source driver SD are distributed to signal lines S in every six line.

Here, the output from the output terminal SS1 of the source driver SD is connected to a signal line S2 via a second switch SW2, is connected to a signal line S8 via a third switch SW3, and is connected to a signal line S14 via the first switch SW1, for example. The control of ON and OFF of the first switch SW1, second switch SW2, and third switch SW3 is carried out by control signals ASW1, ASW2, and ASW3 from the control circuit CTR.

Figure 12:
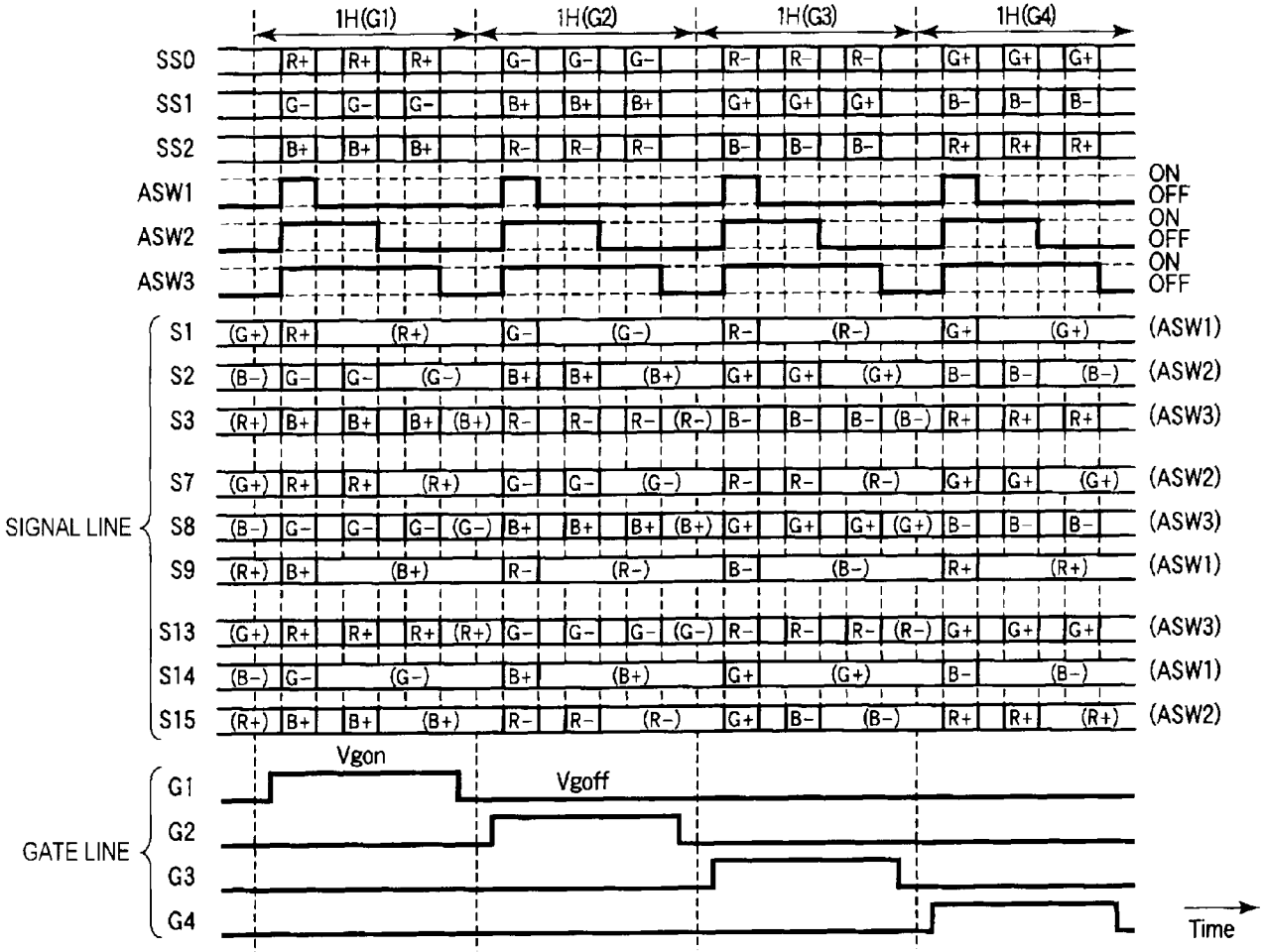
FIG. 12 is a timing chart showing the selection driving operation shown in FIG. 11.

The driving method of the liquid crystal display device shown in FIG. 11 is explained using FIG. 12. The driving method which supplies picture signals to the pixels PX selected by the scanning lines G1~G4 is shown in FIG. 12. In the driving method shown in FIG. 12, polarity inversion is carried out every two row lines of pixels PX selected by the scanning line G, and the second row line and the fourth row line of the pixels PX correspond to starting lines of the polarity reversion.

As shown in FIG. 12, in one horizontal period (1H), the first switch SW1, the second switch SW2, and the third switch SW3 are turned on simultaneously, and picture signals are written in all the signal lines S. Next, the first switch SW1 is turned off, then, the second switch SW2 is turned off, and finally the third switch SW3 is turned off.

In one horizontal period, the ON voltage of the pixel switch SW0 is supplied to the scanning line G, and the picture signal supplied to the signal line S from the source driver SD is written in the pixel electrode PE via the pixel switch SW0. Consequently, the picture signal with a color and a polarity as shown in FIG. 11 is held at each pixel electrode PE.

According to this embodiment, when a pixel switch SW0 connected to an adjoining signal line S is switched, the influence of stray capacitance produced between the pixel electrode PE and the adjoining signal line S can be eliminated. Accordingly, deterioration of the display quality due to the change of the holding potential of the pixel electrode PE is suppressed.

For example, in the line of pixels PX selected by the scanning line G1, a red pixel PXR connected to the signal line S1 via the pixel switch SW0, a green pixel PXG connected to the signal line S2 via the pixel switch SW0 and a blue pixel PXB connected to the signal line S3 via the pixel switch SW0 are observed.

First, in the timing of the beginning of 1 horizontal period (1H (G1)), the first switch SW1 to the third switch SW3 are turned on. At this time, a picture signal R+ is supplied to the signal line S1, and a picture signal R+ is written in the pixel electrode PE via the pixel switch SW0. A picture signal G− is supplied to the signal line S2, and the picture signal G− is written in the pixel electrode PE of the green pixel PXG via the pixel switch SW0.

Once writing operation is performed to the signal line S, the signal written in pixel electrode is held until the signal line S is selected again. A parenthesis (G+), (R−) in FIG. 12 shows the signal potential currently held.

In a next timing of 1 horizontal period (1H (G1)), the first switch SW1 is turned off while the second switch SW2 and the third switch SW3 are maintained in the ON state. Therefore, the picture signal (R+) is held at the pixel electrode PE of the red pixel PXR. The picture signal (G−) is again supplied to the signal line S2 again, and the picture signal (G−) is written in the pixel electrode PE of the green pixel PXG via the pixel switch SW0 again. The picture signal (B+) is supplied to the signal line S3 again, and the picture signal (B+) is written in the pixel electrode PE of the blue pixel PXB via the pixel switch SW0 again.

Here, in the floating state where a signal line S is separated from the output terminal SS of the source driver SD, if the potential of adjoining signal line S fluctuates, the potential of the signal line S in the floating state changes due to the change of the stray (coupling) capacitance produced between the floating signal line S and the adjoining signal line S.

However, in this embodiment, the potential of the signal line S1 is held and the picture signal (G−) is again written in the signal line S2 adjacent to the signal line S1. Since the same signal as the last time is written in the signal line S2 and the potential of the signal line S2 does not change, the coupling is not changed between the signal line S1 and the signal line S2.

Similarly, in the last timing of 1 horizontal period (1H (G1)), the first switch SW1 and the second switch SW2 are turned off, and the third switch SW3 is turned on. Therefore, the picture signal (G−) is held at the pixel electrode PE of the green pixel PXG. A picture signal (B+) is supplied to the signal line S3, and the picture signal (B+) is written in the pixel electrode PE of the blue pixel PXB via the pixel switch SW0.

Here, the potential of signal line S2 is held and the picture signal (B+) is written in the signal line S3 adjacent to the signal line S2. However, since the same signal as the last time is written in the signal line S2 and the potential of the signal line S2 does not change, the coupling produced between the signal line S2 and the signal line S3 does not change.

The polarity of the signals supplied to the signal line S is inversed between 1 horizontal period (1H (G1)) when the scanning line G1 is selected and 1 horizontal period (1H (G2)) when the scanning line G2 is selected. Thus, in the timing when the polarity of the signals is inversed, if the time constant of the signal line S is large, time to write signals in the signal line S becomes long.

However, as mentioned above, insufficient signal write-in to the signal line S can be improved by writing the picture signals in the signal line S a plurality of times, and a liquid crystal display device having good display quality can be obtained.

Here, for example, one comparative example is reviewed. In this example, in 1 horizontal period, the first switch SW1 is turned on, and then the first switch SW1 is turned off while the second switch SW2 is turned on, and further the second switch SW2 is turned off while the third switch SW3 is turned on.

For example, when the first switch SW1 is turned on in the beginning of 1 horizontal period (1H (G1)), the output signals from the output terminals SS0, SS1 and SS2 of the source driver SD, are written in signal lines S1, S9, and S14.

When the second switch SW2 is turned on next, the output signals from the output terminals SS0, SS1, and SS2 of the source driver SD, are written in signal lines S2, S7, and S15.

Here, in the floating state where the signal line S is separated from the output terminal SS of the source driver SD, if a potential of adjoining signal line S fluctuates, the potential of the signal line S in a floating state changes with the stray (coupling) capacitance produced between the adjoining signal lines S and the floating signal lime S. For example, signal lines S2, S8, and S14 in which the signal of picture signal G+ is written in 1 horizontal period (1H (G3)), are observed.

With respect to the signal line S8, since the third switch SW3 is turned on, and the picture signal G+ is written in the pixel electrode PE, in the last timing of the 1 horizontal period (1H (G3)), the signal line 18 does not receive the coupling after that.

However, with respect to the signal line S2, after the second switch SW2 is turned on, and the picture signal G+ is written in the signal line S2, the third switch SW3 is turned on. Accordingly, the potential of the signal line S3 arranged next changes. The coupling between the signal line S2 and the signal line S3 changes due to the potential change of the signal line S3, therefore the potential of the signal line S2 in the floating state is changed.

With respect to the signal line S14, after the first switch SW1 is turned on, and the picture signal G+ is written in the signal line S14, the second switch SW2 is turned on. Consequently, the potential of the signal line S15 arranged next changes, and coupling between the signal line S14 and the signal line S15 changes. Finally the potential of the signal line S14 changes with the potential change of the signal line S15. Successively, the third switch SW3 is turned on, and the potential of the signal line S13 arranged at another next side changes. The coupling between the signal line S14 and the signal line S13 changes, thereby the potential of the signal line S14 changes with the potential change of the signal line S13 again.

According to above operation, the signal voltages held in the signal lines S2, S8, and S14 become slightly different from each other. Consequently, the pixel potential held at the pixel electrodes PE become also slightly different each other, which results in a pattern of light and darkness of luminosity, and is recognized visually as a horizontal stripe or a vertical stripe. This does not become a problem so much, when the gray display is performed, but when performing color display, such as yellow, the stripes appear notably.

On the other hand, if a liquid crystal display device is driven as shown in FIG. 12, the voltage held a pixel electrode PE cannot be affected by the influence of the potential change of an adjoining signal lines S. Therefore, a high quality liquid crystal display device can be obtained.

As mentioned above, according to the liquid crystal display device of this embodiment, it becomes possible to provide a high quality liquid crystal display device using the delta arrangement of pixels and the driving method of the same, which results in low power consumption and a narrow picture frame.

Figure 13:
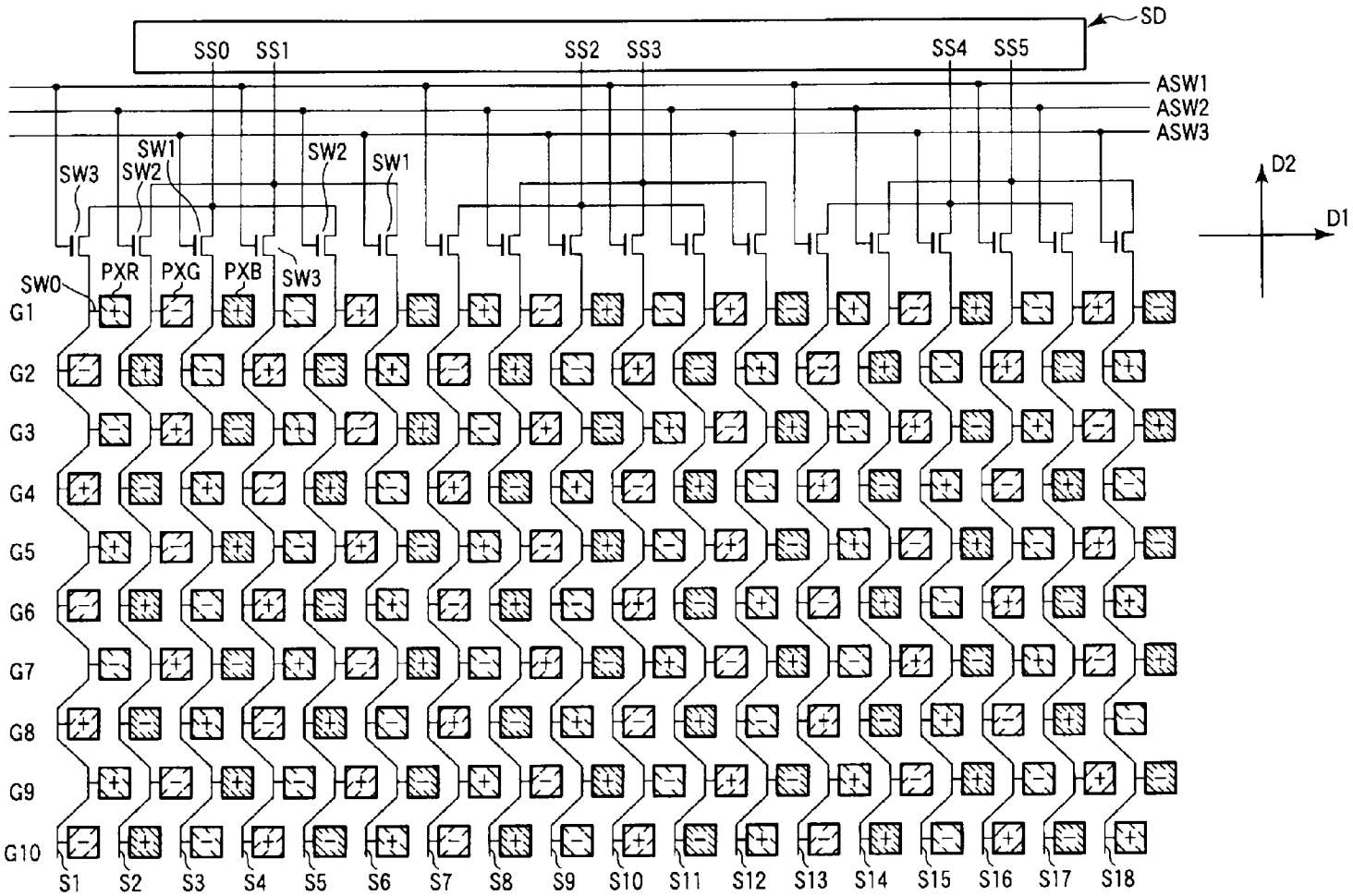
FIG. 13 shows the display portion and the selection circuit in case of conducting the alternating driving operation and the selection driving operation using the pattern layout of pixels shown in FIG. 6 according to a fifth embodiment of the present invention.

A liquid crystal display device and a driving method of the same according to a fifth embodiment of the present invention is explained below with reference to FIG. 13. FIG. 13 shows a display portion and a selection circuit in case of conducting the alternating driving operation and the selection driving operation using the pattern layout of pixels shown in FIG. 6.

In the liquid crystal display device according to this embodiment, a liquid crystal layer includes an OCB mode liquid crystal material to which the liquid crystal is transferred to a bend alignment state from a spray alignment state for a display operation of a normally white. According to this embodiment, the reverse transference from the bend alignment state to the spray alignment state is prevented by periodically applying a high driving voltage (hereafter referred to a black insertion voltage) corresponding to a black display to the liquid crystal layer, for example, as a non-picture signal.

The control circuit CTR performs an initialization processing to the liquid crystal molecule so that the liquid crystal molecule is transferred to the bend alignment state from the spray alignment state by applying an comparatively high opposite common voltage Vcom to the liquid crystal layer at the time of a power ON.

A combination manner with the signal lines S and the output terminals SS0-SS5 of the source driver SD according to this embodiment differs from that of the fourth embodiment as shown in FIG. 11.

The selection circuit MPX is structured so that the output signal from one output terminal SS is distributed to the pixel electrodes PE (PXR, PXG, PXB) to which a plurality of kinds of color picture signals having the same polarity are supplied respectively.

The control circuit CTR includes a selection drive control circuit (not shown) which controls the source driver SD and the selection circuit MPX to distribute a reset signal to the pixels PX in the first period of 1 horizontal period and supply picture signals to the pixels PX in the second period of 1 horizontal period.

In the liquid crystal display device according this embodiment, three signal lines S corresponding to a red pixel PXR, a green pixel PXG, and a blue pixel PXB having the same polarity are selected by a set. For example, the output signal from an output terminal SS0 of the source driver SD is supplied to signal lines S1, S3, and S5, the output signal from an output terminal SS1 to signal lines S2, S4, and S6, and the output signal from output terminal SS2 to signal lines S7, S9, and S11.

For example, when pixels PX are selected by a scanning line G2, the output signal from the output terminal SS0 of the source driver SD is distributed to the signal lines S1, S3, and S5. The picture signal of negative polarity (G−) supplied to the green pixel PXG is distributed to the signal line S1, a picture signal (R−) of the negative polarity supplied to the red PXR is distributed to the signal line S3, and a picture signal (B−) of the negative polarity supplied to the blue pixel PXB is distributed to the signal line S5.

The output signal from the output terminal SS1 of the source driver SD is distributed to the signal lines S2, S4, and S6. The picture signal (B+) of the positive polarity supplied to the blue pixel PXB is distributed to the signal line S2, the picture signal (G+) of the positive polarity supplied to the green pixel PXG is distributed to the signal line S4, and the picture signal (R+) of the positive polarity supplied to the red pixel PXR is distributed to the signal line S6.

The output signal from the output terminal SS2 of the source driver SD is distributed to signal lines S7, S9, and S11. The picture signal (G−) of the negative polarity supplied to the green pixel PXG is distributed to the signal line S7, the picture signal (R−) of the negative polarity supplied to the red pixel PXR is distributed to the signal line S9, and the picture signal (B−) of the negative polarity supplied to the blue pixel PXB is distributed to the signal line S11.

As mentioned above, in 1 horizontal period, the signals outputted from each of the output terminals SS0~SS5 of the source driver SD are signals to be supplied to the red pixel, the green pixel, and the blue pixel of the same polarity respectively. The polarity of the signals outputted from each of the terminals is inversed for every 2 horizontal periods.

Figure 14:
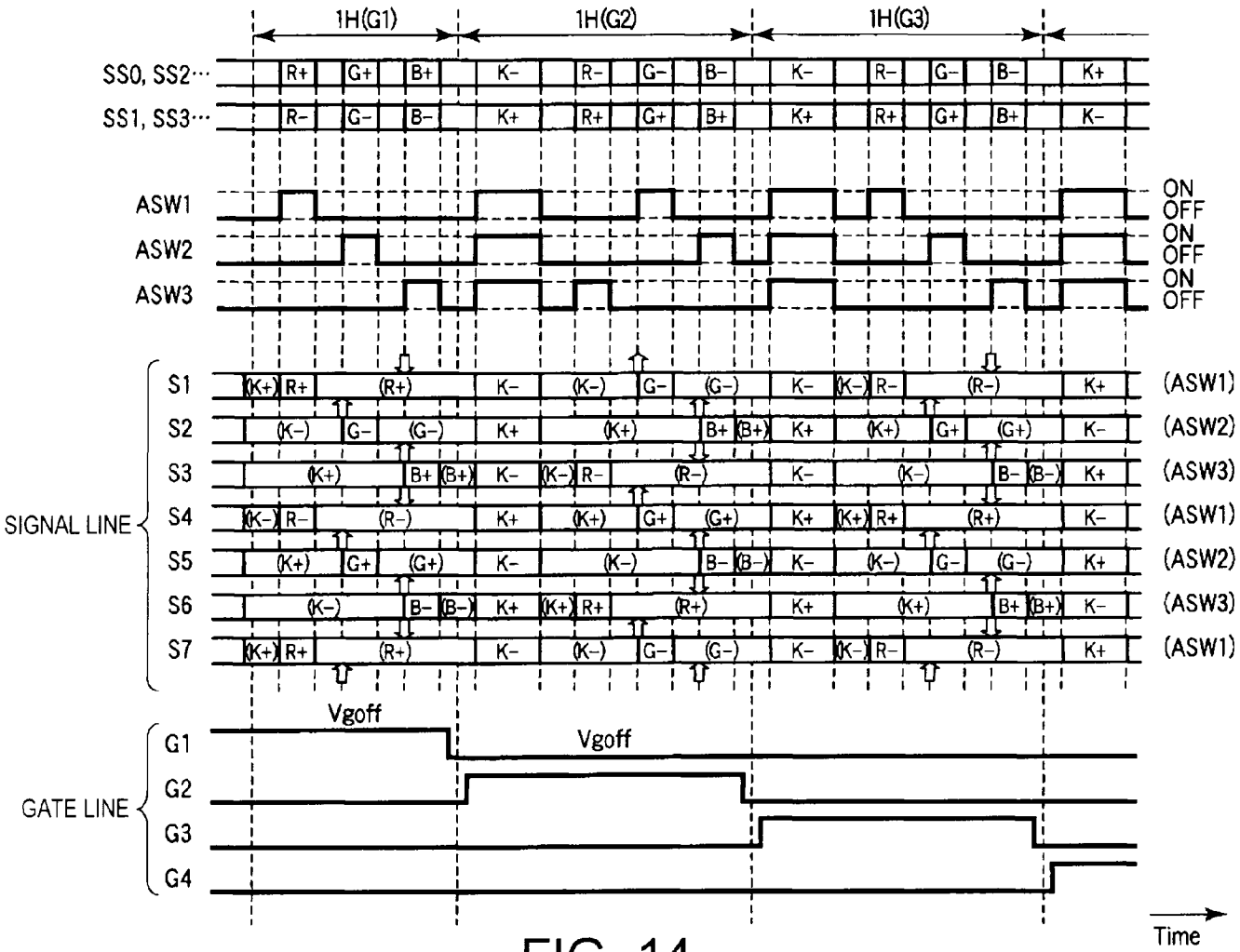
FIG. 14 is a timing chart showing wave forms of the signal lines in case of conducting the selection driving operation shown in FIG. 13.

In the case of distributing the signals from the output terminals SS0~SS5 of the source driver SD to the signal lines S, a driving timing chart of the liquid crystal display device shown in FIG. 13 is shown in FIG. 14. A reset signal is written in the pixel in a head timing of 1 horizontal period. In the liquid crystal display device according this embodiment, the reset signal corresponds to a black display.

That is, in the head timing of 1 horizontal period, the first switch SW1, the second switch SW2, and the third switch SW3 are turned on simultaneously, and the reset signal is supplied to all the pixel PXs which the scanning line G selects.

After the writing of the reset signal, signals from the respective output terminals SS0~SS5 of the source driver SD are outputted in an order of the picture signal (R+ or R−) to the red pixel PXR, the picture signal (G+ or G−) to the green pixel PXG, and the picture signal (B+ or B−) to the blue pixel PXB. On the other hand, the turn that the first switch SW1, the second switch SW2, and the third switch SW3 is turned on is not necessarily the same for each horizontal period (1H).

A potential change of the signal line S is explained at the time of driving the above-mentioned liquid crystal display device. For example, if 1 horizontal period (1H (G2)) is observed, as shown in FIG. 14, a reset signal K+ or a reset signal K− is written in the signal line S corresponding to the output terminals SS0~SS5 of the source driver SD, when the first switch SW1, the second switch SW2, and the third switch SW3 are turned on simultaneously.

For example, the reset signal K− is written in the signal lines S1, S3, and S5 from the output terminal SS0, and the reset signal K+ is written in the signal line S2, S4, and S6 from the output terminal SS1. Next, the third switch SW3 is turned on and corresponding signal lines S3, S6 . . . become in a selected state. At this time, a picture signal (R−) of the negative polarity supplied to the red pixel PXR is written in the signal line S3 from the output terminal SS0, and a picture signal (R+) of the positive polarity supplied to the red pixel PXR from the output terminal SS1 is written in the signal line S6.

Next, the first switch SW1 is turned on, and corresponding signal lines S1, S4 . . . become in a selected state. At this time, the picture signal (G−) of the negative polarity supplied to the green pixel PXG is written in the signal line S1 from the output terminal SS0, and the picture signal (G+) of the positive polarity supplied to the green pixel PXG from the output terminal SS1 is written in the signal line S4.

Finally, the second switch SW2 is turned on and corresponding signal lines S2, S5 . . . become in a selected state. At this time, the picture signal (B−) of the negative polarity supplied to blue pixel PXB is written in the signal line S5 from output terminal SS0, and the picture signal (B+) of the positive polarity supplied to the blue pixel PXB from the output terminal SS1 is written in the signal line S2.

In 1 horizontal period (1H (G2)), since the voltage of the scanning line G2 is ON voltage Vgon as shown in FIG. 13, the picture signal having a desired color and a desired polarity is written in the pixel PX where the scanning line G2 selects. In other 1 horizontal period, picture signals are similarly supplied to the pixels PX. Although FIG. 14 shows a part of period when an ON voltage Vgon is supplied to the scanning lines G1~G4, the scanning lines G are also driven as shown FIG. 14 for other periods (not illustrated).

In FIG. 14, when writing of a picture signal and a reset signal is performed to a certain signal line S, and the potential of the signal line S is changed, influence of the coupling by the potential change of the certain signal line S is given to a liquid crystal capacitance of pixels PX arranged adjacently. An arrow shows a portion where the influence is given. In the timing when the potential of the certain signal line S changes, the arrow is directed toward a signal line S side affected by the influence of the potential change of the certain signal line S.

For example, when only the second switch SW2 is selected in a 1 horizontal period (1H (G2)) period, writing is performed to the signal line S2, and the potential of the signal line S2 is changed from the reset signal K+ of positive polarity to the picture signal B+ corresponding to the blue display of positive polarity. Since the change of the potential gives influence of coupling to adjoining signal lines S1 and S3 at this time, the influence is shown by the arrow.

However, even if coupling arises, when writing is performed again in a sequence within 1 horizontal period, the influence of coupling is not displayed because the influence is balanced. For example, when only the third switch SW3 is selected in a 1 horizontal period (1H (G2)), writing is performed to the signal line S3, and the potential of the signal line S3 is changed from the reset signal K− of negative polarity to the picture signal R− corresponding to the red display of negative polarity.

The change of the potential of the signal line 3 gives an influence of coupling to adjoining signal lines S2 and S4. However, afterward, the second switch SW2 is selected, and a picture signal B+ corresponding to the blue display of positive polarity is written in the signal line S2. Furthermore, the first switch SW1 is selected, and the picture signal G+ corresponding to the green display of positive polarity is written in the signal line S4. Therefore, the influence of coupling by the potential change of signal line S3 is lost.

As mentioned above, if the voltage of the signal lines S shifts slightly due to the influence of the coupling, the voltage is also written in the pixel electrode PE connected to the signal line S. Consequently, the shifted voltage is held in each pixel electrode PE.

When reviewing what kind of coupling each signal line S receives in whole 1H period in case of writing picture signals in the pixel electrode PE in FIG. 13, the result for all the signal lines S is as follows.

Namely, a signal line S in which the picture signal R+ corresponding to the red display of positive polarity was written in is affected by an influence of the potential change of adjoining signal lines S, such as the reset signal K− to the picture signal G− corresponding to the green display of negative polarity, and the reset signal K− to the picture signal B− corresponding to the blue display of negative polarity.

A signal line S in which the picture signal R− corresponding to the red display of negative polarity was written in is affected by an influence of the potential change of adjoining signal lines S, such as the reset signal K+ to picture signal G+ corresponding to the green display of positive polarity, and the reset signal K+ to the picture signal B+ corresponding to the blue display of positive polarity.

A signal line S in which the picture signal G+ corresponding to the green display device of positive polarity was written in is affected by an influence of the potential change from the reset signal K− to the picture signal B− corresponding to the blue display of negative polarity.

A signal line S in which the picture signal G− corresponding to the green display device of negative polarity was written in is affected by an influence of the potential change of the adjoining signal line S, such as the reset signal K+ to the picture signal B+ corresponding to the blue display of positive polarity.

Signal line S in which a picture signal B+ corresponding to the blue display device of positive polarity was written in is not affected by the influence of the potential change of adjoining signal line S. Similarly, a picture signal B− corresponding to the blue display of negative polarity is not also affected by the influence of the potential change of adjoining signal line S.

As mentioned above, the potential change by which the written picture signals are influenced is common for the written picture signals with the same color and the same polarity.

When the polarity inversion of the signals supplied to the pixel electrodes PE is carried out for every one frame, the writing of the signal corresponding to the red display of positive polarity and the signal corresponding to the red display of negative polarity are inversed for every one frame period, for example. That is, the influence of the potential change is balanced for the signal lines S and the pixel electrodes PE in which the picture signals corresponding to all the red displays are written.

Therefore, in case of where all the pixels display single color, even if the holding potential slightly shifts under the influence of the potential change of adjacent signal lines S, the amount of the potential shift is the same for the whole display area. Accordingly, a vertical stripe and a horizontal stripe do not arise and a uniform display can be obtained. This is the same not only in a gray and a monochrome (red, blue, green) display but in all the displays, including other colors such as yellow, cyan, and magenta.

The above effects are acquired, if an order of the signal writing in each horizontal period as follows: in an order of the reset signal K+ of positive polarity, the picture signal R+ corresponding to the red display, the picture signal G+ corresponding to the green display and the picture signal B+ corresponding to the blue display, or in an order of the reset signal K− of negative polarity, the picture signal R− corresponding to the red display, the picture signal G− corresponding to green display, and the picture signal B− corresponding to the blue display.

In FIG. 13, the set of the signal lines S that are distributed from one output terminal SS of the source driver SD, is constituted by the picture signal R corresponding to the red display, the picture signal G corresponding to the green display, and the picture signal B corresponding to the blue display, which have the same polarity, respectively. However, the set may be constituted by adjacent three signal lines S.

Although this embodiment explains the case where the source driver SD outputs the picture signals within 1 horizontal period in a following order: the picture signal R corresponding to the red display, the picture signal G corresponding to the green display, and the picture signal B corresponding to the blue display having the same polarity, respectively. However, following another order is applicable: the signal G corresponding to the green display, the picture signal R corresponding to the red display, and the picture signal B corresponding to the blue display having the same polarity, respectively. Further following other order is also applicable: the picture signal B corresponding to the blue display, the picture signal G corresponding to the green display and the picture signal R corresponding to the red display, respectively in the liquid crystal display device according to this embodiment.

As long as reset signals K+ and K− are fixed voltages in a full screen, the voltage value may be arbitrarily decided. In this embodiment, although the reset signals K+ and K− are the voltages corresponding to a black display, they may be the voltages corresponding to a white display, for example.

Although the reset signals K+ and K− are set to a common fixed voltage for a red pixel PXR, a green pixel PXG, and a blue pixel PXB, the reset signals K+ and K− may be set to different voltage value for every color pixels.

For example, the period when the reset signal is divided into three sub-periods, and further the respective voltage values outputted from the source driver SD are slightly changed. Accordingly, slightly different reset voltages K+ and K− can be respectively supplied to the signal lines S connected to the red pixel PXR, the green pixel PXG, and the blue pixel PXB. According to the above embodiment, a uniform display device and a driving method using the same without a vertical stripe and a horizontal stripe are obtained like the preceded embodiments.

By the way, a black insertion drive is known as a driving method of a liquid crystal display device. In the driving method, a black display is inserted in a predetermined ratio during one frame period to improve visibility of moving pictures. In order to perform a black insertion driving, an OCB liquid crystal having a high speed response is used well.

On the other hand, in the OCB mode liquid crystal, it is known that the black insertion driving is also suitable to prevent a reverse transference.

In the black insertion drive, it is necessary to perform two signal writings of the color signals and the picture signal corresponding to the black display within one frame period. The driving timing shown in FIG. 14 is very suitable for the black insertion drive.

That is, the black insertion driving is realized by dividing 1 horizontal period into the first period (reset signals K+, K− writing) and the second period (picture signals R±, G±, B± writing) following the first period, and using the reset signals K+ and K− as the black insertion signals.

Figure 15:
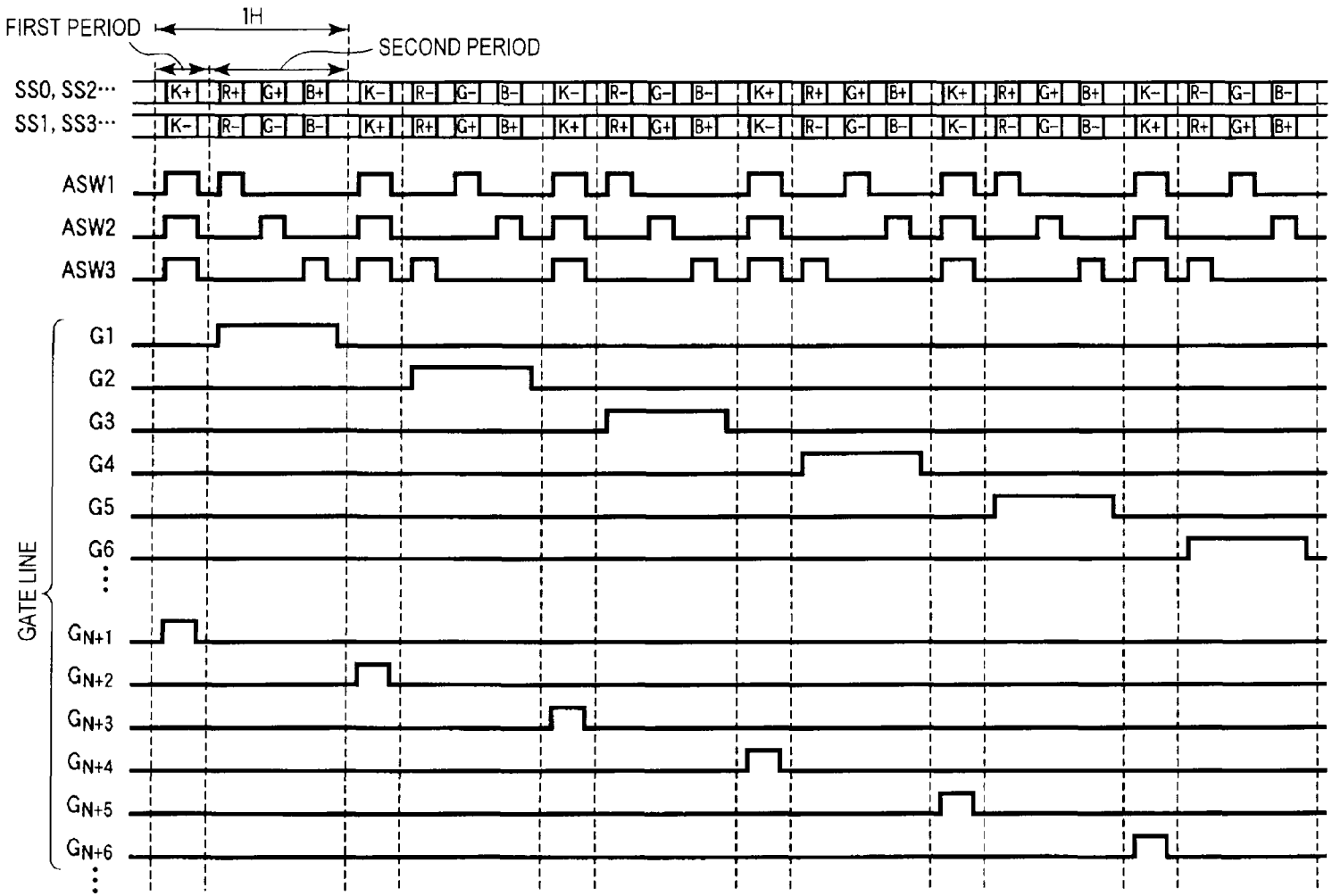
FIG. 15 is a timing chart showing wave forms of the scan lines in case of conducting the selection driving operation shown in FIG. 13.

FIG. 15 shows a timing chart including potential of the scanning line G according to a sixth embodiment. The black color signal write-in scan is performed to lines GN+1~GN+6 using the first period of 1 horizontal period (1H), that is, only corresponding period to write-in the reset signal K+, or the reset signal K−. Furthermore, the picture signal write-in scan is performed in the scan lines G1~G6 using only the second period of 1 horizontal period (1H), i.e., a period corresponding to write the picture signals R±, G±, and B±.

As mentioned above, since the driving timing shown in FIG. 14 can be combined with the black insertion driving, visibility of the moving pictures can be improved. Accordingly, while the same effect as the preceding embodiments is obtained, it also becomes possible to raise the visibility of the moving pictures.

The present invention is not limited directly to the above described embodiments. In practice, the structural elements can be modified without departing from the spirit of the invention. Various inventions can be made by properly combining the structural elements disclosed in the embodiments. For example, some structural elements may be omitted from all the structural elements disclosed in the embodiments. Furthermore, structural elements in different embodiments may properly be combined. It is to therefore be understood that within the scope of the appended claims, the present invention may be practiced other than as specifically disclosed herein.

What is claimed is:

1. A liquid crystal display device comprising:

a display portion including a first substrate, a second substrate opposing to the first substrate, a liquid crystal layer held between the first and second substrates, and a plurality of pixels to display red, green and blue colors arranged in a delta shape;

the first substrate including;

(a) a plurality of pixel electrodes respectively arranged in the pixels, (b) scanning lines extending in a first direction, the signal lines extending in a space between the pixel electrodes in a meandering shape in a second direction, (c) signal lines extending in a second direction crossing orthogonally with the first direction, and (c) pixel switches arranged around a crossing area of the scanning lines with the signal lines, corresponding to respective pixel electrodes, a signal line driving circuit and a scanning line driving circuit to drive the scanning lines and signal lines respectively, a selection circuit to distribute an output signal outputted from an output terminal of the signal line driving circuit to two or more signal lines in a time sharing, the selection circuit being structured so as to distribute the output signals from the output terminal to respective signal lines to supply the signals with the same color and the same polarity to the pixel electrode, a polarity inversion circuit to inverse respective polarity of signals supplied to the pixel electrodes arranged in the first direction one by one base and to inverse respective polarity of the signals supplied to the pixel electrodes from a common signal line every two or more pixel electrodes arranged adjacently along the common signal line, and a plurality of auxiliary capacitance lines extending in the first direction, wherein the pixel electrode includes auxiliary capacitance generated by a voltage applied between the pixel electrode and the auxiliary capacitance line, and the auxiliary capacitance line is coupled with the pixel electrode into which one of a signal of positive polarity and a signal of negative polarity through the auxiliary capacitance is written.

2. The liquid crystal display device according to claim 1, further comprising;

a control circuit to control the selection circuit so as to supply a reset signal to the pixels at a first period and picture signals at a second period within 1 horizontal scan time.

3. The liquid crystal display device according to claim 2, wherein the liquid crystal layer includes an OCB mode liquid crystal material in which the liquid crystal is transferred to a bend alignment state from a spray alignment state by applying a voltage.

4. The liquid crystal display device according to claim 3, wherein a reverse transference from the bend alignment state to the spray alignment state is prevented by periodically applying the reset signal corresponding to a black display to the liquid crystal layer.

5. The liquid crystal display device according to claim 4, wherein the period when the reset signal is divided into three sub-periods, and respectively supplied to signal lines connected to the red pixel, the green pixel and the blue pixel.

6. The liquid crystal display device according to claim 5, wherein the voltage values of the respective reset signals is slightly different each other.

7. The liquid crystal display device according to claim 1, further comprising, a selection driving control circuit to control the selection circuit so as to supply the same signal to at least one of two or more signal lines two or more times within 1 horizontal scan time.

8. The liquid crystal display device according to claim 1, wherein the auxiliary capacitance lines include first and second capacitance lines arranged in turn, and signals having positive and negative polarities are supplied to the first and second capacitance lines respectively.

9. A method of driving a liquid crystal display device having a display portion including a first substrate, a second substrate opposing to the first substrate, a liquid crystal layer held between the first and second substrates, and a plurality of pixels arranged in a delta shape; the first substrate including, a plurality of pixel electrodes respectively arranged in the pixels, scanning lines extending in a first direction, signal lines extending in a second direction crossing orthogonally with the first direction, and pixel switches arranged around a crossing area of the scanning lines and the signal lines, corresponding to respective pixel electrodes, the method comprising the steps of:

forming the signal lines extending in a space between the pixel electrodes in a meandering shape in a second direction, and two kinds of color pixels connected with a common signal line by turn via the pixel switch, turning on the pixel switch by the scanning line sequentially driven under control of a scanning line driving circuit, writing a signal into the pixels via the pixel switch from the signal lines under control of a signal line driving circuit, inversing respective polarity of signals supplied to the pixel electrodes arranged in the first direction one by one base and respective polarity of the signals supplied to the pixel electrodes from a common signal line every two or more pixel electrodes arranged adjacently.

10. The method of driving a liquid crystal display device according to claim 9 further having a selection circuit to distribute output signals from the output terminal of the signal line driving circuit to respective signal lines to supply signals with the same color and the same polarity to the pixel electrodes, and the signal lines including a first signal line connected with the output terminal through a first switch, a second signal line connected with the output terminal through a second switch, a third signal line connected with the output terminal through a third switch, the method comprising the steps of:

turning on the first, second and the third switches by controlling the selection circuit within 1 horizontal scan time, turning off the first switch while the second and third switches are turned on, turning off the first and second switches while the third switch is turned on, and turning off the first, second and third switches.

11. The method of driving a liquid crystal display device according to claim 10 further having a selection circuit to distribute output signals from the output terminal of the signal line driving circuit to supply signals with the same polarity to the pixel electrodes, the signal line including a first signal line connected with the output terminal through a first switch, a second signal line connected with the output terminal through a second switch, and a third signal line connected with the output terminal through a third switch, and the method further comprising the steps;

supplying a reset signal to the signal lines from the output terminal of the signal driving circuit so as to distribute the reset signal by turning on the first, second and third switches at a first period within 1 horizontal scan time, and supplying picture signals to the signal lines from the output terminal of the signal driving circuit so as to sequentially distribute the picture signals in a predetermined order by turning on the first, second and third switches at a second period within 1 horizontal scan time.

12. A method of driving a liquid crystal display device according to claim 11;

wherein the liquid crystal layer includes an OCB mode liquid crystal material in which the liquid crystal is transferred to a bend alignment state from a spray alignment state, a reverse transference from the bend alignment state to the spray alignment state is prevented by periodically applying the reset signal corresponding to a black display to the liquid crystal.

13. A liquid crystal display device comprising:

a display portion including a first substrate, a second substrate opposing to the first substrate, a liquid crystal layer held between the first and second substrates, and a plurality of pixels arranged in a delta shape;

the first substrate including;

a plurality of pixel electrodes respectively arranged in the pixels, scanning lines extending in a first direction, signal lines extending in a second direction crossing orthogonally with the first direction, and pixel switches arranged around a crossing area of the scanning lines with the signal lines, corresponding to respective pixel electrodes, and;

wherein the signal lines extend in a space between the pixel electrodes in a meandering shape in a second direction, and two kinds of color pixels are connected with a common signal line by turn via the pixel switch;

a driving circuit to drive the scanning lines and the signal lines, a selection circuit to distribute an output signal outputted from an output terminal of the signal line driving circuit to two or more signal lines in a time sharing, the selection circuit being structured so as to distribute the output signals from its output terminal to respective pixel signal lines to supply signals with the same color and the same polarity to the pixel electrodes, and a control circuit to control the driving circuit and the selection circuit, the control circuit including a selection driving control circuit to control the driving circuit and the selection circuit so as to supply the same signal to at least one of two or more signal lines two or more times within 1 horizontal scan time.

14. The liquid crystal display device according to claim 13, further comprising a driving circuit to drive the scanning lines and the signal lines, wherein the driving circuit includes a polarity inversion circuit to inverse respective polarity of signals supplied to the pixel electrodes arranged in the first direction one by one base and to inverse respective polarity of the signals supplied to the pixel electrodes from a common signal line every two or more pixel electrodes arranged adjacently along the common signal line.

15. The liquid crystal display device according to claim 14, further comprising a plurality of auxiliary capacitance lines extending in the first direction in parallel with the scanning line, wherein the pixel electrode includes auxiliary capacitance generated by a voltage applied between the pixel electrode and the auxiliary capacitance line, and the respective auxiliary capacitance lines are coupled with the pixel electrode into which one of a signal of positive polarity and a signal of negative polarity is written through the auxiliary capacitance.

16. The liquid crystal display device according to claim 15, wherein the auxiliary capacitance lines include first and second capacitance lines arranged in turn, and signals having positive and negative polarities are supplied to the first and second capacitance lines respectively.

17. A liquid crystal display device comprising:

a display portion including a first substrate, a second substrate opposing to the first substrate, a liquid crystal layer held between the first and second substrates, and a plurality of pixels arranged in a delta shape;

the first substrate including;

a plurality of pixel electrodes respectively arranged in the pixels, scanning lines extending in a first direction, signal lines extending in a second direction crossing orthogonally with the first direction, and pixel switches arranged around a crossing area of the scanning lines with the signal lines, corresponding to respective pixel electrodes, and;

wherein the signal lines extend in a space between the pixel electrodes in a meandering shape in a second direction, and two kinds of color pixels are connected with a common signal line by turn via the pixel switch;

a driving circuit to drive the scanning lines and the signal lines, a selection circuit to distribute an output signal outputted from an output terminal of the driving circuit to two or more signal lines in a time sharing, the selection circuit being structured so as to distribute the output signals from its output terminal to respective signal lines to supply signals with the same color and the same polarity to the pixel electrodes, and a control circuit to control the driving circuit and the selection circuit, the control circuit including a selection driving control circuit to control the driving circuit and the selection circuit so as to supply a reset signal to the pixels at a first period and picture signals at a second period within 1 horizontal scan time.

18. The liquid crystal display device according to claim 17, wherein the selection driving control circuit controls the driving circuit and the selection circuit so as to supply the same signal to at least one of two or more signal lines two or more times within 1 horizontal scan time.

19. The liquid crystal display device according to claim 17, wherein the liquid crystal layer includes an OCB mode liquid crystal material in which the liquid crystal is transferred to a bend alignment state from a spray alignment state, a reverse transference from the bend alignment state to the spray alignment state is prevented by periodically applying the reset signal corresponding to a black display to the liquid crystal layer.

20. The liquid crystal display device according to claim 17, further comprising a driving circuit to drive the scanning lines and the signal lines, wherein the driving circuit includes a polarity inversion circuit to inverse respective polarity of signals supplied to the pixel electrodes arranged in the first direction one by one base and to inverse respective polarity of the signals supplied to the pixel electrodes from a common signal line every two or more pixel electrodes arranged adjacently along the common signal line.

21. The liquid crystal display device according to claim 20, further comprising a plurality of auxiliary capacitance lines extending in the first direction in parallel with the scanning line, wherein the pixel electrode includes auxiliary capacitance generated by a voltage applied between the pixel electrode and the auxiliary capacitance line, and the respective auxiliary capacitance lines are coupled with the pixel electrode into which one of a signal of positive polarity and a signal of negative polarity is written through the auxiliary capacitance.

22. The liquid crystal display device according to claim 21, wherein the auxiliary capacitance lines include first and second capacitance lines arranged in turn, and signals having positive and negative polarities are supplied to the first and second capacitance lines respectively.

* * * * *